US007555253B2

(12) United States Patent
Mizumoto

(10) Patent No.: US 7,555,253 B2
(45) Date of Patent: Jun. 30, 2009

(54) SEMICONDUCTIVE RUBBER MEMBER AND DEVELOPING ROLLER COMPOSED OF SEMICONDUCTIVE RUBBER MEMBER

(75) Inventor: Yoshihisa Mizumoto, Hyogo (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 260 days.

(21) Appl. No.: 11/783,850

(22) Filed: Apr. 12, 2007

(65) Prior Publication Data

US 2007/0243984 A1 Oct. 18, 2007

(30) Foreign Application Priority Data

Apr. 14, 2006 (JP) ..... 2006-111969

(51) Int. Cl.
*G03G 15/08* (2006.01)

(52) U.S. Cl. ..... 399/286

(58) Field of Classification Search ..... 399/147, 399/154, 252, 265, 279, 286; 492/25, 56, 492/59; 428/29, 492
See application file for complete search history.

(56) References Cited

U.S. PATENT DOCUMENTS

| | | | | |
|---|---|---|---|---|
| 5,733,235 | A * | 3/1998 | Waku et al. | 492/25 |
| 2004/0110617 | A1 | 6/2004 | Mizumoto | |
| 2008/0107456 | A1 * | 5/2008 | Mizumoto et al. | 399/286 |

FOREIGN PATENT DOCUMENTS

| | | | |
|---|---|---|---|
| JP | 2004-170845 | A | 6/2004 |
| JP | 2005-225969 | A | 8/2005 |

* cited by examiner

*Primary Examiner*—Hoan H Tran
(74) *Attorney, Agent, or Firm*—Birch, Stewart, Kolasch & Birch, LLP

(57) ABSTRACT

A developing roller including a semiconductive rubber member having not less than two vulcanized layers including a base layer composed of a vulcanized electro-conductive rubber composition and a surface layer composed of a vulcanized rubber composition. An electric resistance value of the base layer is set to not more than $10^7\Omega$, when the electric resistance value of the base layer is measured by applying a voltage of 100V thereto at a temperature of 10° C. and a relative humidity of 20%. An electric resistance value of a laminate of all layers including the base layer and the surface layer is set not more than $10^7\Omega$ in the same condition as the above-described condition in which the electric resistance value of the base layer is measured.

10 Claims, 3 Drawing Sheets

SEMICONDUCTIVE RUBBER MEMBER AND DEVELOPING ROLLER COMPOSED OF SEMICONDUCTIVE RUBBER MEMBER

This nonprovisional application claims priority under 35 U.S.C. § 119(a) on Patent Application No(s). 2006-111969 filed in Japan on Apr. 14, 2006, the entire contents of which are hereby incorporated by reference.

BACKGROUND OF THE INVENTION

1. Field of the Invention

The present invention relates to a semiconductive rubber member for use in a developing roller, a cleaning roller, a cleaning blade, a charging roller, and the like to be mounted on an electrophotographic apparatus. More particularly, the present invention relates to a semiconductive rubber member for use in a developing roller to be mounted on an image-forming mechanism of the electrophotographic apparatus in which an unmagnetic one-component toner is used to transport the toner to an electrophotographic photoreceptor by imparting a high electrostatic property thereto.

2. Description of the Related Art

In recent years, in the printing technique using an electrophotographic method, a high-speed printing operation, formation of a high-quality image, formation of a color image, and miniaturization of image-forming apparatuses have been progressively made and become widespread. Toner holds the key to these improvements. To satisfy the above-described demands, it is necessary to form finely divided toner particles, make the diameters of the toner particles uniform, and make the toner particles spherical. Regarding the technique of forming the finely divided toner particles, toner having a diameter not more than 10 μm and not more than 5 μm have been developed recently. Regarding the technique of making the toner spherical, toner having not less than 99% in its sphericity has been developed.

To form the high-quality image, polymerized toner has come to be widely used instead of pulverized toner conventionally used. The polymerized toner allows the reproducibility of dots to be excellent in obtaining digital information as a printed sheet and hence a high-quality printed sheet to be obtained. It is possible to adjust the degree of the electrostatic property of the polymerized toner more easily than the pulverized toner. Further it is possible to prevent a variation of the particle diameters of the polymerized toner to be filled in a cartridge and a variation of degrees of the electrostatic property thereof.

In recent years, development of compact, lightweight, and inexpensive image-forming apparatuses are demanded owing to spread of personal use of the image-forming apparatus represented by printers and owing to a demand for space-saving of an office. On such a background, instead of a two-component toner containing magnetic powder which is capable of realizing the formation of a high-quality image but is an obstacle in miniaturizing the image-forming apparatus and making it lightweight, the use of a one-component toner not using the magnetic powder is rapidly spreading.

When the two-component toner using the magnetic powder is used, toner can be transported to the electrophotographic photoreceptor comparatively easily owing to electric and magnetic actions. But when the unmagnetic one-component toner is used, it is impossible to utilize the magnetic action in transporting the toner. Therefore it is necessary to uniformly form the surface of the developing roller which is an electrode end surface. To uniformly attach toner having small diameters of micron order to the surface of the developing roller, the electrical properties of the developing roller represented by the electric resistance value are demanded to be very uniform inside the developing roller so that when a bias electric potential is applied to the developing roller, a very uniform electric potential distribution is obtained.

Because the one-component toner does not contain magnetic toner, the developing roller is demanded to have a function of controlling the degree of the electrostatic property of the toner. That is, the developing roller is demanded to charge the toner and keep the electrostatic property imparted to the toner. If the toner has an insufficient charged amount, it has an insufficient electrostatic force. Thereby the toner is not faithfully transported to an electrostatic latent image formed on the electrophotographic photoreceptor. Thereby various defective images are generated. For example, there occurs a variation in the print density owing to a rotation of the developing roller, a development ghost, a photographic fog, and the like.

To comply with the above-described demands, a developing roller having the base material consisting of silicone rubber and the surface layer, consisting of urethane coating, which is disposed on the base material has been developed and used recently. But the silicone rubber used as the base material of the developing roller is expensive, and the yield is low in the step of forming the urethane coating. Such being the case, researches are now made to develop a developing roller, composed of ionic-conductive vulcanized rubber, which can be produced at a low cost and easily controlled in the electric resistance value thereof.

For example, in the conductive rubber roller disclosed in Japanese Patent Application Laid-Open No. 2004-170845 (Patent document 1), the outermost layer is composed of the ionic-conductive rubber to which a specific dielectric loss tangent-adjusting filler is added to adjust the dielectric loss tangent thereof to the range from 0.1 to 1.5.

The above-described conductive rubber roller provides a very high-quality image in various environmental conditions. In the case of a durability test, it is possible to prevent photographic fog from occurring because the charged amount of toner does not decrease and prevent toner from leaking mainly from a sealing portion of the roller. Normally, toner leak occurs owing to wear of the roller. Thus the conductive rubber roller can be used as a preferable developing roller.

When the above-described developing roller is used at a low temperature and a low humidity at an earlier time of the life of a toner cartridge when toner has been appropriately used and is apt to be charged, the electric resistance value of the roller rises because the outermost layer thereof is composed of the ionic-conductive rubber. Thereby the charged amount of the toner increases. Consequently the print density is liable to drop. Thus the roller has room to be improved in this respect.

In Japanese Patent Application Laid-Open No. 2005-225969 (Patent document 2), there is disclosed the semiconductive rubber member in which wax is added to the ionic-conductive rubber component. According to the disclosure made in the example of the specification, when the semiconductive rubber member is used as a developing roller, a favorable initial image is formed. This is because the surface free energy decreases owing to the addition of the wax to the ionic-conductive rubber component, and toner separates from the roller favorably. As a result, there is an increase in the print density.

But the semiconductive rubber member has room to be improved in the print density in the low temperature and humidity condition.

Patent document 1: Japanese Patent Application Laid-Open No. 2004-170845

Patent document 2: Japanese Patent Application Laid-Open No. 2005-225969

SUMMARY OF THE INVENTION

It is an object of the present invention to provide a semiconductive rubber member whose electric resistance value is restrained from rising to a possible highest extent even in a low temperature and humidity condition to stabilize a charged amount of toner so that the semiconductive rubber member does not cause a print density to decrease; and a developing roller composed of the rubber member.

To achieve the object, the present invention provides a semiconductive rubber member having not less than two vulcanized rubber layers including a surface layer composed of a vulcanized rubber composition and a base layer composed of a vulcanized electro-conductive rubber composition. An electric resistance value of the base layer is set to not more than $10^7\Omega$, and an electric resistance value of a laminate of all layers including the base layer and the surface layer is set to not more than $10^7\Omega$, when the electric resistance value of the base layer and that of the laminate are measured by applying a voltage of 100V to the base layer and the laminate respectively at a temperature of 10° C. and a relative humidity of 20%.

In recent years, the use of an ionic-conductive rubber composition has rapidly spread instead of an electroconductive rubber composition, because the electric resistance value of the electro-conductive rubber composition is liable to fluctuate. The present inventors have investigated the electroconductive rubber composition and found that it is advantageous to utilize the property of the electroconductive rubber composition that the electric resistance value thereof rises little even in a low temperature and humidity condition.

More specifically, the rubber layer composed of the electroconductive rubber composition is disposed at the side of the core or the shaft of the roller as the base layer, whereas the rubber layer composed of the rubber composition which does not substantially show electroconductivity and has a higher electric resistance value than the base layer is layered on the base layer. Thereby when the rubber member including the base layer and the surface layer is operated in the low temperature and humidity condition, the electric resistance value of the base layer little rises, even though the electric resistance value of the surface layer rises. Therefore the electric resistance value of the entire laminate, namely, the electric resistance value of the rubber member is restrained from rising. The surface layer suppresses a variation of the electric resistance value which occurs because the base layer shows electroconductivity. Consequently the semiconductive rubber member of the present invention is capable of charging toner as uniformly as the conventional semiconductive rubber members composed of the ionic-conductive rubber composition and thus provides a high-quality image. Further the semiconductive rubber member of the present invention prevents a decrease of a print density in the low temperature and humidity condition unlike conventional products composed of the ionic-conductive rubber composition.

The semiconductive rubber member of the present invention has not less than two vulcanized rubber layers including the surface layer composed of the vulcanized rubber composition and the base layer composed of the vulcanized electro-conductive rubber composition.

One or not less than two intermediate layers may be present between the surface layer and the base layer. The composition and construction of the intermediate layer are not specifically restricted unless the composition and construction thereof do not depart from the object of the present invention.

The semiconductive rubber member having two layers of the surface layer and the base layer has a simple construction and can be produced easily and is thus preferable from the standpoint of industrial production.

To prevent a decrease of the print density in the condition of the low temperature and humidity, the electric resistance value of the semiconductive rubber member is set to not more than $10^7\Omega$ and more favorably not more than $10^{6.5}\Omega$ when the electric resistance value thereof is measured by applying the voltage of 100V thereto at the temperature of 10° C. and the relative humidity of 20%. The lower limit value of the electric resistance value thereof is not specifically restricted, but set to favorably not less than $10^4\Omega$ to eliminate the possibility of discharge.

The electric resistance value of the semiconductive rubber member of the present invention is measured by a method described in the example which will be described later, supposing that the semiconductive rubber member of the present invention is roller-shaped.

It is favorable to set the electric resistance value of the semiconductive rubber member to not more than $10^7\Omega$, when the electric resistance values thereof is measured by applying the voltage of 100V thereto in the condition of a normal temperature of 23° C. and a normal relative humidity of 25% and in the condition of a high temperature of 30° C. and a high relative humidity of 80%. The lower limit of the electric resistance value of the semiconductive rubber member is not specifically restricted, but preferably not less than $10^4\Omega$.

The electric resistance value of the base layer of the semiconductive rubber member is set to not more than $10^7\Omega$, when the electric resistance value is measured by applying the voltage of 100V thereto at the temperature of 10° C. and the relative humidity of 20%. By suppressing the rise of the electric resistance value of the base layer at the low temperature and humidity condition, it is possible to suppress the rise of the entire electric resistance value of the semiconductive rubber member, as described above. It is more favorable to set the electric resistance value of the base layer to not more than $10^6\Omega$.

The lower limit of the electric resistance value of the base layer is set to favorably $10^2\Omega$ and more favorably $10^3\Omega$ so that the electric resistance of the semiconductive rubber member of the present invention is intermediate.

The electric resistance value of the base layer is measured by using the same method as that used to measure the electric resistance value of the semiconductive rubber member of the present invention after the surface layer and the intermediate layer are removed therefrom.

The ratio (hereinafter referred to as "electric resistance deflection") of the maximum value of the electric resistance value of the base layer to the minimum value of the electric resistance value thereof is set to favorably less than 20, more favorably less than 10, and most favorably not more than 3.0. If the electric resistance deflection is not less than 20, the variation of the electric resistance of the base layer cannot be sufficiently suppressed, even though the semiconductive rubber member includes the surface layer disposed on the base layer. Thereby it is impossible to make the electric resistance value of the semiconductive rubber member of the present invention uniform.

It is preferable that the electric resistance value of the surface layer of the semiconductive rubber member is set higher than that of the base layer thereof, when the electric resistance value of each of the surface layer and the base layer is measured by applying the voltage of 100V thereto at the temperature of 10° C. and the relative humidity of 20%. In other words, it is preferable that the electric resistance value of the semiconductive rubber member is set higher than that of the base layer, when the electric resistance value of each of the semiconductive rubber member and the base layer is measured by applying the voltage of 100V thereto at the temperature of 10° C. and the relative humidity of 20%.

By setting the electric resistance value of the surface layer higher than that of the base layer, the surface layer suppresses a variation of the electric resistance of the semiconductive rubber member which occurs because the base layer shows electroconductivity. Thereby it is possible to make the electric resistance value of the semiconductive rubber member of the present invention uniform.

The semiconductive rubber member of the present invention has different electric resistance values according to the use thereof. The base layer thereof has also different electric resistance values according to the composition thereof. Thus the volume resistivity of the surface layer cannot be the limitedly, but is set to not less than $10^{10}\Omega\cdot$cm nor more than $10^{15}\Omega\cdot$cm.

The volume resistivity of the surface layer is measured by using a method described in the example which will be described later after only the surface layer thereof is shaven off from the semiconductive rubber member.

It is preferable that in the semiconductive rubber member of the present invention, adjacent layers are integrated with each other without using an adhesive agent (primer) and that an adhesive layer is not present between the adjacent layers. The adhesive layer changes the entire electrical characteristic of the semiconductive rubber member greatly.

To improve adhesion between the two adjacent rubber layers, it is preferable that the two adjacent rubber layers contain the same rubber component.

It is preferable that the base layer of the semiconductive rubber member of the present invention is thickest. By making the base layer thick, it is possible to suppress the rise of the electric resistance value of the semiconductive rubber member more effectively in the condition of low temperature and humidity. More specifically, the thickness of the base layer is set to favorably not less than 50%, more favorably not less than 70%, and most favorably not less than 90% of the entire thickness of the semiconductive rubber member of the present invention. It is desirable that the base layer has a possible largest thickness. The upper limit value of the thickness of the base layer is not specifically restricted. Thus it is possible to make the thickness of the surface layer as small as 10 μm, as the thickness of the base layer becomes thicker. But if the thickness of the surface layer is too small, it is difficult to process the rubber composition into the semiconductive rubber member having such a thin surface layer. In consideration of processability, the thickness of the base layer is set to favorably not less than 60% nor more than 95% and more favorably not less than 70% nor more than 90% of the entire thickness of the semiconductive rubber member of the present invention.

A rubber composition composing the base layer is described below.

The rubber composition composing the base layer is required to show electro-conductivity. Normally a rubber composition containing a rubber component and an electro-conductive agent mixed therewith is used as the rubber composition composing the base layer.

The rubber component is not specifically limited, but known elastomers can be used. For example, it is possible to list ethylene-propylene-diene rubber (hereinafter referred to as EPDM), butadiene rubber (hereinafter referred to as BR), isoprene rubber, chloroprene rubber, natural rubber, acrylonitrile butadiene rubber (hereinafter referred to as NBR), styrene butadiene rubber (hereinafter referred to as SBR), styrene rubber, butyl rubber, halogenated butyl rubber, polyisoprene rubber, chlorosulfonated polyethylene rubber, acrylic rubber, urethane rubber, silicone rubber, polyether copolymers, and epichlorohydrin copolymers, and the like. These elastomers can be used singly or in combination of two or more thereof.

As the rubber component of the electro-conductive rubber composition composing the base layer, it is preferable to use non-polar rubber such as EPDM, BR, and the like; and polar rubber such as SBR, NBR, chloroprene rubber, and urethane rubber having a high dissolution parameter (SP value) respectively; and ionic-conductive rubber such as a epichlorohydrin copolymer having a polyether bond. These rubber components can be used singly or as mixtures of not less than two kinds thereof. It is preferable that the entire rubber component contains the chloroprene rubber.

The chloroprene rubber is produced by emulsion polymerization of chloroprene. In dependence on the kind of a molecular weight modifier, the chloroprene rubber is classified into a sulfur-modified type and a sulfur-unmodified type.

The chloroprene rubber of the sulfur-modified type is formed by plasticizing a polymer resulting from polymerization of sulfur and the chloroprene with thiuram disulfide or the like so that the resulting chloroprene rubber of the sulfur-modified type has a predetermined Mooney viscosity. The chloroprene rubber of the sulfur-unmodified type includes a mercaptan-modified type and a xanthogen-modified type. Alkyl mercaptans such as n-dodecyl mercaptan, tert-dodecyl mercaptan, and octyl mercaptan are used as a molecular weight modifier for the mercaptan-modified type. Alkyl xanthogen compounds are used as a molecular weight modifier for the xanthogen-modified type.

In dependence on a crystallization speed of generated chloroprene rubber, the chloroprene rubber is classified into an intermediate crystallization speed type, a slow crystallization speed type, and a fast crystallization speed type.

Both the chloroprene rubber of the sulfur-modified type and the sulfur-unmodified type can be used in the present invention. But it is preferable to use the chloroprene rubber of the sulfur-unmodified type having the slow crystallization speed.

In the present invention, as the chloroprene rubber, it is possible to use rubber or elastomer having a structure similar to that of the chloroprene rubber. For example, it is possible to use copolymers obtained by polymerizing a mixture of the chloroprene and at least one monomer copolymerizable with the chloroprene. As monomers copolymerizable with the chloroprene, it is possible use 2,3-dichloro-1,3-butadiene, 1-chloro-1,3-butadiene, sulfur, styrene, acrylonitrile, methacrylonitrile, isoprene, butadiene, acrylic acid, methacrylic acid, and esters thereof.

As the electro-conductive agent contained in the electro-conductive rubber composition composing the base layer, it is possible to use conductive carbon black such as Ketchen black, furnace black, acetylene black; conductive metal oxides such as zinc oxide, potassium titanate, antimony-doped titanium oxide, and tin oxide; graphite; and carbon fibers. It is preferable to use the conductive carbon black.

The mixing amount of the electro-conductive agent is different according to the kind thereof and thus cannot be the limitedly. Therefore the mixing amount thereof should be appropriately selected in consideration of properties of the rubber composition such as the electric resistance value and rubber hardness thereof. For example, the mixing amount thereof for 100 parts by mass of the rubber component is set to 5 to 60 parts by mass, favorably 8 to 40 parts by mass, more favorably 10 to 30 parts by mass, and most favorably 15 to 25 parts by mass.

The rubber composition composing the surface layer is described below.

As the rubber composition composing the surface layer, a substantially insulating rubber composition or an ionic-conductive rubber composition is used.

The "substantially insulating rubber composition" means a composition having a volume resistivity of $10^{10}\Omega\cdot$cm to $10^{15}\Omega\cdot$cm, when the volume resistivity thereof is measured by applying a voltage of 100V thereto in the condition where the surface layer composed of the "substantially insulating rubber composition" has the temperature of 10° C. and the relative humidity of 20%.

Known rubber compositions can be used, provided that they satisfy the above-described condition. More specifically, it is possible to use non-polar rubber such as EPDM, BR, and the like; and polar rubber such as SBR, NBR, chloroprene rubber, and urethane rubber having a high dissolution parameter (SP value) respectively. Of these rubbers, it is preferable to use the EPDM as the non-polar rubber and the chloroprene rubber and the NBR as the polar rubber. The chloroprene rubber is especially preferable.

The EPDM rubber includes an unextended type consisting of a rubber component and an extended type containing the rubber component and extended oil. Although both the unextended type and the extended type can be used in the present invention, the unextended type is more favorable than the extended type. As examples of diene monomers contained in the EPDM rubber, dicyclopentadiene, methylenenorbornene, ethylidenenorbornene, 1,4-hexadiene, and cyclooctadiene are listed. The EPDM containing the ethylidenenorbornene as the diene monomer is preferable.

Chloroprene rubber of the sulfur-unmodified type is preferable.

When the rubber composition contains the chloroprene rubber, the mixing amount thereof for 100 parts by mass of the entire rubber component is set to favorably not less than five parts by mass to allow the rubber component to be ozone-resistant and more favorably not less than 10 parts by mass to allow the entire rubber component to be uniform. When the chloroprene rubber is mixed with other kind of rubber, the mixing amount thereof is set to favorably not more than 90 parts by mass.

The chloroprene rubber contains a lot of chlorine and is capable of easily charging toner to be charged positively. Therefore by using the chloroprene rubber for a developing roller for use in a printer in which the toner to be charged positively is used, the developing roller displays excellent charging property. More specifically, when the chloroprene rubber is used for the developing roller for use in the printer in which the toner to be charged positively is used, the mixing amount of the chloroprene rubber for 100 parts by mass of the rubber component is set to favorably not less than 20 parts by mass and more favorably to not less than 30 parts by mass. Thereby the developing roller is capable of providing an excellent performance of imparting an electrostatic property to the toner to be positively charged.

When the chloroprene rubber is used as the rubber component of the semiconductive rubber member, the polar rubber may be mixed therewith. It is especially preferable to mix the NBR with the chloroprene rubber. By so doing, it is possible to suppress a rise of the hardness of the rubber component and decrease the degree of dependence thereof on temperature.

In mixing the NBR with the chloroprene rubber to form the rubber component of the semiconductive rubber member, the mixing amount of the NBR for 100 parts by mass of the entire rubber component is set to 5 to 95 parts by mass. To allow the rubber component to have a low hardness, the mixing amount of the NBR for 100 parts by mass of the entire rubber component is set to favorably not less than 10 parts by mass. To allow the rubber component to be ozone-resistant, the mixing amount of the NBR for 100 parts by mass of the entire rubber component is set to favorably not more than 90 parts by mass. The mixing amount of the NBR is different according to the polarity of toner. When the rubber composition is used for the developing roller for use in the image-forming apparatus in which the toner to be positively charged is used, the mixing amount of the NBR for 100 parts by mass of the entire rubber component is set to not more than 50 parts by mass and favorably not more than 20 parts by mass to prevent a decrease of the charged amount of the toner. To substantially obtain the effect of suppressing a rise of the hardness of the rubber component and decreasing the degree of dependence thereof on temperature, the mixing amount of the NBR for 100 parts by mass of the entire rubber component is set to not less than five parts by mass. In order for the chloroprene rubber to favorably impart the electrostatic property to the toner, it is preferable that the chloroprene rubber is contained in the entire rubber component more than the NBR rubber or the polyether copolymer.

When the semiconductive rubber member of the present invention is used for the developing roller for use in the image-forming apparatus in which unmagnetic one-component toner to be charged negatively is used, it is preferable that the mixing amount of the NBR rubber for 100 parts by mass of the entire rubber component composing the surface layer is set to not less than 20 parts by mass.

The NBR rubber has acrylonitrile groups which are polar groups and is capable of easily charging toner to be negatively charged, whereas the chloroprene rubber charges the toner to be positively charged. Therefore by using the NBR rubber for the developing roller for use in a printer in which the toner to be negatively charged is used, the developing roller displays a superior electrostatic property. More specifically, the semiconductive rubber member is provided with performance of negatively charging the toner when it contains not less than 20 parts by mass of the NBR rubber and more favorably not less than 30 parts by mass thereof for 100 parts by mass of the rubber component.

The rubber composition often contains carbon black as a reinforcing agent thereof. When the mixing amount of the carbon black is large, the rubber composition has a low electric resistance value, thus showing electroconductivity. Thus the rubber composition does not satisfy the above-described condition. Therefore it is necessary to pay attention to the mixing amount of the carbon black.

It is preferable to set the mixing amount of the conductive carbon black to not more than 10 parts by mass for 100 parts by mass of the rubber component. When the conductive carbon black is not used as the carbon black but weakly conductive carbon black which is described in detail below is used, the mixing amount of the weakly conductive carbon black does not affect the electric resistance value of the semiconductive rubber member. Thus the range of the mixing amount of the weakly conductive carbon black is as wide as not less than 5 parts by mass nor more than 70 parts by mass for 100 parts by mass of the rubber component.

As the ionic-conductive rubber composition, it is possible to use known compositions including an ionic-conductive composition containing an ionic-conductive rubber as the rubber component thereof or a composition in which an ionic-conductive agent is mixed with a rubber component.

As the ionic-conductive rubber, a rubber material having a polar group in the composition thereof can be used. More specifically, it is possible to use an epichlorohydrin copolymer and a polyether copolymer.

As the epichlorohydrin copolymers, it is possible to use epichlorohydrin homopolymer, an epichlorohydrin-ethylene oxide copolymer, an epichlorohydrin-propylene oxide copolymer, an epichlorohydrin-allyl glycidyl ether copolymer, an epichlorohydrin-ethylene oxide-allyl glycidyl ether copolymer, an epichlorohydrin-propylene oxide-allyl glycidyl ether copolymer, and an epichlorohydrin-ethylene oxide-propylene oxide-allyl glycidyl ether copolymer.

As the polyether copolymers, it is possible to use an ethylene oxide-propylene oxide-allyl glycidyl ether copolymer, an ethylene oxide-allyl glycidyl ether copolymer, propylene oxide-allyl glycidyl ether copolymer, an ethylene oxide-propylene oxide copolymer, and the like.

These copolymers may be used singly or in mixtures of not less than two kinds thereof.

When the epichlorohydrin copolymer and the polyether copolymer are used in combination, it is preferable to set the mixing amount of the epichlorohydrin copolymer to not less than 50 parts by mass nor more than 90 and the mixing amount of the polyether copolymer to not less than 10 parts by mass nor more than 50 for 100 parts by mass of the rubber component.

Copolymers containing the ethylene oxide are more favorable. The ethylene oxide stabilizes a lot of ions and thus allows the semiconductive rubber member to have a low electric resistance. But when copolymers contain the ethylene oxide at a very high percentage, the ethylene oxide crystallizes and the segment motion of the molecular chain thereof is prevented from taking place. Consequently there may be a rise in the specific volume resistance value of the copolymer, the hardness of vulcanized rubber, and the viscosity of unvulcanized rubber.

Thus the epichlorohidrin copolymer contains the ethylene oxide at not less than 30 mol % nor more than 95 mol %, favorably not less than 55 mol % nor more than 95 mol %, and more favorably not less than 60 mol % nor more than 80 mol %. It is more favorable that the polyether copolymer contains the ethylene oxide at 50 to 95 mol %.

It is preferable that the polyether copolymer contains the allyl glycidyl ether in addition to the ethylene oxide. By copolymerizing the allyl glycidyl ether with the ethylene oxide, the allyl glycidyl ether unit obtains a free volume as a side chain. Thus the crystallization of the ethylene oxide is suppressed. As a result, the semiconductive rubber member has a lower electric resistance than conventional semiconductive rubber members. By copolymerizing the allyl glycidyl ether with the ethylene oxide, carbon-to-carbon double bonds are introduced into the polyether copolymer. Thus it is possible to crosslink it with other kind of rubber and thereby prevent occurrence of bleeding and an electrophotographic photoreceptor from being contaminated.

It is preferable that the polyether copolymer contains 1 to 10 mol % of the allyl glycidyl ether. When the polyether copolymer contains less than one mol % of the allyl glycidyl ether, bleeding and contamination of the electrophotographic photoreceptor are liable to occur. On the other hand, when the polyether copolymer contains more than 10 mol % of the allyl glycidyl ether, it is impossible to obtain the effect of suppressing crystallization to a higher extent, and the number of crosslinked points increases after vulcanization. Thus it is impossible to allow the semiconductive rubber member to have a low electric resistance value. In addition, the tensile strength, fatigue characteristic, and flexing resistance of the semiconductive rubber member deteriorate.

As the epichlorohidrin copolymer, it is especially preferable to use an epichlorohidrin (EP)-ethylene oxide (EO)-allyl glycidyl ether (AGE) copolymer. As the content ratio among the EO, the EP, and the AGE in the epichlorohidrin copolymer, EO:EP:AGE is set to favorably 30 to 95 mol %:4.5 to 65 mol %:0.5 to 10 mol % and more favorably 40 to 80 mol %:15 to 60 mol %:2 to 6 mol %. As the epichlorohidrin copolymer, it is also possible to use an epichlorohidrin (EP)-ethylene oxide (EO) copolymer. As the content ratio between the EO and the EP, EO:EP is set to favorably 30 to 80 mol %:20 to 70 mol % and more favorably 50 to 80 mol %:20 to 50 mol %.

As the polyether copolymer to be used in the present invention, it is preferable to use an ethylene oxide (EO)-propylene oxide (PO)-allyl glycidyl ether (AGE) terpolymer. By copolymerizing the propylene oxide with the ethylene oxide and the allyl glycidyl ether, it is possible to suppress the crystallization of the ethylene oxide to a higher extent. A preferable content ratio among the ethylene oxide (EO), the propylene oxide (PO), and the allyl glycidyl ether (AGE) in the polyether copolymer is EO:PO:AGE=50 to 95 mol %:1 to 49 mol %:1 to 10 mol %. To effectively prevent bleeding from occurring and the electrophotographic photoreceptor from being contaminated, it is preferable that the number-average molecular weight Mn of the ethylene oxide (EO)-propylene oxide (PO)-allyl glycidyl ether (AGE) terpolymer is not less than 10,000.

The ionic-conductive rubber may be combined with other kind of rubber component not showing ionic conductivity. In that case, it is preferable to set the mixing amount of the ionic-conductive rubber to not less than 20 parts by mass and less than 100 parts by mass for 100 parts by mass of the entire rubber component.

As the other kind of the rubber component, known elastomers can be used. Above all, the chloroprene rubber and the NBR can be preferably used. These elastomers can be used singly or in combination of not less than two kinds thereof.

Various types of the chloroprene rubber described above can be used. The sulfur-unmodified type can be preferably used.

As the NBR, it is possible to use any of low-nitrile NBR containing the acrylonitrile at not more than 25%, intermediate-nitrile NBR containing the acrylonitrile in the range of 25 to 31%, moderate high-nitrile NBR containing the acrylonitrile in the range of 31 to 36%, and high-nitrile NBR containing the acrylonitrile at not less than 36%. To decrease the specific gravity of the rubber composition, it is preferable to use the low-nitrile NBR having a small specific gravity.

When the chloroprene rubber is used in combination with the ionic-conductive rubber, the mixing amount of the chloroprene rubber can be appropriately selected in the range of five to 90 parts by mass for 100 parts by mass of the entire rubber component. In order for the chloroprene rubber to favorably impart the electrostatic property to the toner, the mixing amount of the chloroprene rubber is set to favorably not less than five parts by mass for 100 parts by mass of the entire rubber component. To make the rubber uniform, the mixing amount of the chloroprene rubber is set to more favorably not less than 10 for 100 parts by mass of the entire rubber component. It is more favorable that the upper limit of the mixing amount of the chloroprene rubber is set to 80 parts by mass for 100 parts by mass of the entire rubber component.

When the NBR is used in combination with the ionic-conductive rubber, the content of the NBR for 100 parts by mass of the entire rubber component is set to the range of 5 to 95 parts by mass, favorably in the range of 10 to 90 parts by mass, and more favorably in the range of 10 to 80 parts by mass. The mixing amount of the NBR for 100 parts by mass of the entire rubber component is set especially favorably to 15 to 65 parts by mass and most favorably to 20 to 50 parts by mass. To prevent the semiconductive rubber member from deteriorating owing to oxidation caused by ozone and heat generated in a printer, the content of the NBR for 100 parts by mass of the entire rubber component is set to favorably not more than 80 parts by mass. It is preferable that the content of the NBR is set to not less than 5 parts by mass for 100 parts by mass of the entire rubber component to suppress an increase of the hardness of the rubber component and substantially obtain the effect of decreasing the dependence of the semiconductive rubber member on temperature. It is preferable to add an age resistor to the rubber component.

The following preferable modes in which the other rubber component not showing the ionic conductivity combined with the ionic-conductive rubber are listed:

(1) Combination of the epichlorohydrin copolymer or/and the polyether copolymer and the chloroprene rubber.

(2) Combination of the epichlorohydrin copolymer or/and the polyether copolymer and the NBR.

(3) Combination of the epichlorohydrin copolymer or/and the polyether copolymer, the NBR, and the chloroprene rubber.

Above all, the combination of the epichlorohydrin copolymer, the polyether copolymer, and the chloroprene rubber or the combination of the epichlorohydrin copolymer, the chloroprene rubber, and the NBR is especially favorable.

In the mode (1), the content of the chloroprene rubber for 100 parts by mass of the rubber component is set to favorably not more than 90 parts by mass, more favorably not more than 80 parts by mass, and most favorably not more than 70 parts by mass. In order for the chloroprene rubber to favorably impart the electrostatic property to the toner, the content of the chloroprene rubber is set to not less than 5 parts by mass and favorably not less than 10 parts by mass for 100 parts by mass of the rubber component. When the mixture of the mode (1) has a small toner-charging performance, the mixing amount of the chloroprene rubber is set to favorably not less than 20 parts by mass for 100 parts by mass of the rubber component.

It is preferable that the mol % of a chloroprene monomer composing the chloroprene rubber is set higher than that of the ethylene oxide contained in the epichlorohydrin copolymer or/and the polyether copolymer.

When the chloroprene rubber and the epichlorohydrin copolymer are combined with each other, it is preferable that the total mol % of the chloroprene monomer composing the chloroprene rubber and the epichlorohydrin is set higher than the mol % of the ethylene oxide.

When the chloroprene rubber, the epichlorohydrin copolymer, and the polyether copolymer are combined with one another, the content of the epichlorohydrin copolymer for 100 parts by mass of the entire rubber component is set to 5 to 90 parts by mass and favorably 10 to 70 parts by mass. In this case, the content of the polyether copolymer is set to 5 to 40 parts by mass and favorably 5 to 20 parts by mass for 100 parts by mass of the rubber component. In this case, the content of the chloroprene rubber is set to 5 to 90 parts by mass and favorably 10 to 80 parts by mass for 100 parts by mass of the entire rubber component. By setting the mixing ratio among the three components to the above-described ratio, it is possible to favorably disperse the three components and improve the properties such as the strength of the mixture. It is more favorable to set the mass ratio among the epichlorohydrin copolymer, the chloroprene rubber, and the polyether copolymer to 2 to 5:4 to 7:1.

In the rubber composition of the mode (3), the NBR and the chloroprene rubber are mixed with each other. When the chloroprene rubber finely disperses, the mixture of the NBR and the chloroprene rubber is mixed with the epichlorohydrin copolymer or/and the polyether copolymer. As a result, although the NBR and the chloroprene rubber have different functional groups, both disperse very finely. As the effect of the dispersion of three or four kinds of rubbers, it is possible to decrease the compression set of the rubber composition, provide it with a low hardness, and improve the elongation percentage thereof. In addition, owing to a synergistic effect to be brought about by these effects and a decrease of the specific gravity of the rubber composition, it is possible to dramatically improve the wear resistance of the rubber composition.

It is favorable that the mixing amount of the epichlorohydrin copolymer or/and the polyether copolymer for 100 parts by mass of the entire rubber component is set to not less than 5 parts by mass to disperse the chloroprene rubber and the NBR. It is more favorable that the mixing amount of the epichlorohydrin copolymer or/and the polyether copolymer for 100 parts by mass of the entire rubber component is set to not less than 15 parts by mass to allow the rubber composition to be ionic-conductive.

It is favorable that the mixing amount of the NBR is set to not less than 5 parts by mass for 100 parts by mass of the entire rubber component to enhance the dispersibility of the NBR with the chloroprene rubber. To improve the elongation percentage of the rubber composition, it is favorable that the mixing amount of the NBR for 100 parts by mass of the rubber component is set to not less than 10 parts by mass. To prevent the rubber composition from deteriorating, the mixing amount of the NBR for 100 parts by mass of the rubber component is set to favorably not more than 95 parts by mass, more favorably not more than 80 parts by mass, and most favorably not more than 65 parts by mass.

It is favorable that the mixing amount of the chloroprene rubber is set to not less than 5 parts by mass for 100 parts by mass of the entire rubber component to enhance the dispersibility of the chloroprene rubber with the NBR. To keep a favorable balance among various properties of the rubber composition, the mixing amount of the chloroprene rubber for 100 parts by mass of the entire rubber component is set to favorably the range of 5 to 90 parts by mass, more favorably the range of 10 to 80 parts by mass, and most favorably the range of 20 to 70 parts by mass.

A favorable mass ratio among the epichlorohydrin copolymer or/and the polyether copolymer:the chloroprene rubber: the NBR rubber is set to 2 to 5:4 to 7:1.

As the ionic-conductive rubber composition, a composition containing a rubber component and an ionic-conductive agent added thereto is listed in addition to the composition containing the above-described ionic-conductive rubber.

As the above-described rubber component, known elastomers can be used. The polar rubbers such as NBR, the chloroprene rubber, and the urethane rubber are preferable. The ionic-conductive agent may be added to the ionic-conductive rubber.

The mixing amount of the ionic-conductive agent can be appropriately selected according to the kind thereof. For example, it is preferable to add 0.1 to 5 parts by mass of the ionic-conductive agent to 100 parts by mass of the rubber component.

Various ionic-conductive agents can be selectively used. For example, it is possible to use anion-containing salts having fluoro groups (F—) and sulfonyl groups (—$SO_2$). More specifically, it is possible to use salts of bisfluoroalkylsulfonylimide, salts of tris (fluoroalkylsulfonyl) methane, and salts of fluoroalkylsulfonic acid. As cations of the above-described salts making a pair with the anions, those of ions of the alkali metals, the group 2A, and other metals are favorable. A lithium ion is more favorable. As the ionic-conductive agents, it is possible to list $LiCF_9SO_3$, $LiN(SO_2CF_3)_2$, $LiC(SO_2CF_3)$, $LiCH(SO_2CF_3)_2$, and $LiSF_6CF_2SO_3$.

Because the electric charge of the anion-containing salts having the fluoro groups and the sulfonyl groups are not localized owing to a strong electron attraction effect, anions are stable. Thus the anion-containing salts having the fluoro groups and the sulfonyl groups display a high degree of dissociation and realize a very high degree of ionic conductivity. The rubber composition containing the rubber component and the anion-containing salt having the fluoro groups and the sulfonyl groups added thereto is allowed to have a low electric resistance efficiently. Thus by appropriately adjusting the mixing ratio of the polymer component, it is possible to provide the rubber composition having a low electric resistance and prevent the electrophotographic photoreceptor from being contaminated.

In addition to the above-described ionic-conductive agents, it is possible to add borates, lithium salts, and ammonium salts to the ionic-conductive rubber. The chloroprene is compatible with chlorine and halogen salts. Thus when the chloroprene is used, the chloroprene stabilizes very favorably with ammonium perchlorate, salts of boron, and salts of imide lithium. Therefore the rubber composition containing the chloroprene is capable of suppressing exudation when the roller composed of the rubber composition is successively used, thus preventing the electrophotographic photoreceptor or the like from being contaminated.

The above-described electro-conductive rubber composition composing the base layer and the rubber composition composing the surface layer contain a vulcanizing agent for vulcanizing the rubber component.

As the vulcanizing agent, it is possible to use sulfur-based and thiourea-based vulcanizing agents, triazine derivatives, peroxides, and monomers. These vulcanizing agents can be used singly or in combination of two or more of them.

As the sulfur-based vulcanizing agent, it is possible to use powdery sulfur, organic sulfur-containing compounds such as tetramethylthiuram disulfide, N,N-dithiobismorpholine, and the like.

As the thiourea-based vulcanizing agent, it is possible to use tetramethylthiourea, trimethylthiourea, ethylenethiourea, and thioureas shown by $(C_nH_{2n+1}NH)_2C{=}S$ (n=integers 1 to 10).

As the peroxides, benzoyl peroxide is exemplified.

The mixing amount of the vulcanizing agent for 100 parts by mass of the rubber component is set to favorably not less than 0.2 parts by mass nor more than five parts by mass and more favorably not less than one nor more than three parts by mass.

In the present invention, it is preferable to use sulfur and thioureas in combination as the vulcanizing agent.

The mixing amount of the sulfur for 100 parts by mass of the rubber component composing the base and surface layers is set to favorably not less than 0.1 parts by mass nor more than 5.0 parts by mass and more favorably not less than 0.2 parts by mass nor more than 2 parts by mass. When the mixing amount of the sulfur for 100 parts by mass of the rubber component is less than 0.1 parts by mass, the vulcanizing speed of the entire rubber composition is slow and thus the productivity thereof is low. On the other hand, when the mixing amount of the sulfur for 100 parts by mass of the rubber component is more than 5.0 parts by mass, there is a possibility that the compression set of the rubber composition is high and the sulfur and an accelerating agent bloom.

The mixing amount of the thioureas for 100 g of the rubber component composing the base and surface layers is set to favorably not less than 0.0009 mol nor more than 0.0800 mol and more favorably not less than 0.0015 mol nor more than 0.0400 mol. By mixing the thioureas with the rubber component in the above-described mixing range, blooming and the contamination of the electrophotographic photoreceptor hardly occur, and further motions of rubber molecules are hardly prevented. Thus the rubber composition is allowed to have a low electric resistance and excellent in its mechanical properties such as a compression set. As the addition amount of the thioureas is increased to increase the crosslinking density, the electric resistance value of the rubber composition can be decreased. That is, when the mixing amount of the thioureas for 100 g of the rubber component is less than 0.0009 mol, it is difficult to improve the compression set of the rubber composition and decrease the electric resistance value thereof. On the other hand, when the mixing amount of the thioureas for 100 g of the rubber component is more than 0.0800 mol, there is a possibility that the thioureas bloom from the surface of the rubber composition, thus contaminate the electrophotographic photoreceptor. Also, there is another possibility of deteriorating the mechanical properties of the rubber composition such as the breaking extension thereof to a high extent.

In dependence on the kind of the vulcanizing agent, a vulcanizing accelerating agent or a vulcanizing accelerating assistant agent may be added to the rubber component.

As the vulcanizing accelerating agent, it is possible to use inorganic accelerating agents such as slaked lime, magnesia (MgO), and litharge (PbO); and organic accelerating agents shown below. The organic accelerating agent includes guanidines such as di-ortho-tolylguanidine, 1,3-diphenyl guanidine, 1-ortho-tolylbiguanide, salts of the di-ortho-tolylguanidine of dicatechol borate; thiazoles such as 2-mercapto-benzothiazole, dibenzothiazolyl disulfide; sulfenamides such as N-cyclohexyl-2-benzothiazylsulfenamide; thiurams such as tetramethylthiuram monosulfide, tetramethylthiuram disulfide, tetraethylthiuram disulfide, and dipentamethylenethiuram tetrasulfide; and thioureas. It is possible to use the above-described substances singly or in combination.

The mixing amount of the vulcanizing accelerating agent is set to favorably not less than 0.1 nor more than 10 parts by mass and more favorably not less than 0.2 nor more than eight parts by mass for 100 parts by mass of the rubber component composing the base and surface layers.

The following vulcanizing accelerating assistants can be used: metal oxides such as zinc white; fatty acids such as stearic acid, oleic acid, cotton seed fatty acid, and the like; and known vulcanizing accelerating assistants.

The addition amount of the vulcanizing accelerating agent for 100 parts by mass of the rubber component composing the base and surface layers is set to favorably not less than 0.1 parts by mass nor more than 10 parts by mass and more favorably not less than 0.2 parts by mass nor more than eight parts by mass.

In addition to the above-described components, the electro-conductive rubber composition composing the base layer and the rubber composition composing the surface layer may appropriately contain the following additives unless the use thereof departs from the object of the present invention: a plasticizing agent, a processing aid, a deterioration retarder, a filler, a scorch retarder, an ultraviolet ray absorber, a lubricant, a pigment, an antistatic agent, a flame retardant, a neutralizer, a core-forming agent, a foam prevention agent, and a crosslinking agent.

As the plasticizer, it is possible to use dibutyl phthalate (DBP), dioctyl phthalate (DOP), tricresyl phosphate, and wax. As the processing aid, fatty acids such as stearic acid can be used. It is preferable that the mixing amounts of these plasticizing components are not more than five parts by mass for 100 parts by mass of the rubber component to prevent bleeding from occurring when the oxide film is formed on the surface layer and prevent the electrophotographic photoreceptor from being contaminated when the developing roller composed of the rubber composition is mounted on a printer and the like and when the printer or the like is operated. In this respect, it is most favorable to use polar wax as the plasticizer.

As the deterioration retarder, various age resistors and antioxidants can be used. When the antioxidant is used as the deterioration retarder, it is preferable to appropriately select the mixing amount thereof to efficiently form the oxide film on the surface layer.

As the filler, the following powdery fillers can be used: zinc oxide, silica, carbon, carbon black, clay, talc, calcium carbonate, magnesium carbonate, aluminum hydroxide, and alumina. The rubber composition containing the filler is allowed to have an improved mechanical strength and the like. By using alumina and titanium oxide for the rubber composition, it is effectively release heat generated at a sealing portion of the developing roller composed of the rubber composition and improve the wear resistance thereof, because the alumina and the titanium oxide have a high thermal conductivity.

The mixing amount of the filler for 100 parts by mass of the rubber component composing the base and surface layers is set to favorably not more than 80 parts by mass and more favorably not more than 60 parts by mass.

As the scorch retarder, it is possible to use N-(cyclohexylthio)phthalimide; phthalic anhydride, N-nitrosodiphenylamine, 2,4-diphenyl-4-methyl-1-pentene. These scorch retarders can be used singly or in combination.

The mixing amount of the scorch retarder for 100 parts by mass of the rubber component is set to favorably not less than 0.1 nor more than 5 parts by mass and more favorably not less than 0.1 parts by mass nor more than 1 part by mass.

When the electro-conductive rubber composition composing the base layer and the rubber composition composing the surface layer contain halogen-containing rubber represented by the epichlorohydrin copolymer, it is preferable that both rubber compositions contain an acid-accepting agent. In this case, it is possible to prevent remaining of a chlorine gas generated when the rubber is vulcanized and the electrophotographic photoreceptor from being contaminated.

As the acid-accepting agent, it is possible to use various substances acting as acid acceptors. As the acid-accepting agent, hydrotalcites or magsarat can be favorably used because they have preferable dispersibility. The hydrotalcites are especially favorable. By using the hydrotalcites in combination with a magnesium oxide or a potassium oxide, it is possible to obtain a high acid-accepting effect and securely prevent the electrophotographic photoreceptor from being contaminated.

The mixing amount of the acid-accepting agent for 100 parts by mass of the rubber component composing each layer is set to favorably not less than 1 nor more than 10 parts by mass and more favorably not less than 1 nor more than 5 parts by mass. The mixing amount of the acid-accepting agent for 100 parts by mass of the rubber component is set to favorably not less than one part by mass to allow the acid-accepting agent to effectively display the effect of preventing inhibition of vulcanization and the electrophotographic photoreceptor from being contaminated. The mixing amount of the acid-accepting agent for 100 parts by mass of the rubber component is set to favorably not more than 10 parts by mass to prevent the hardness of the rubber component from increasing.

To decrease the dielectric loss tangent of the semiconductive rubber member of the present invention, a dielectric loss tangent-adjusting agent may be added to the rubber component. It is preferable that the rubber composition composing the surface layer contains the dielectric loss tangent-adjusting agent.

As the dielectric loss tangent-adjusting agent, weakly conductive carbon black or calcium carbonate treated with fatty acid is used. It is preferable to use the weakly conductive carbon black.

The weakly conductive carbon black is large in its particle diameter, has a low extent of development in its structure, and has a small degree of contribution to the conductivity of the semiconductive rubber composition. The semiconductive rubber composition containing the weakly conductive carbon black is capable of obtaining a capacitor-like operation owing to a polarizing action without increasing the electrical conductivity thereof and controlling the electrostatic property to be imparted to the toner without deteriorating the uniformity of the electric resistance thereof.

It is possible to efficiently obtain the above-described effect by using the weakly conductive carbon black whose primary particle diameter is not less than 80 nm and preferably not less than 100 nm. When the primary particle diameter is not more than 100 nm and preferably not more than 250 nm, it is possible to remarkably reduce the degree of the surface roughness of the surface layer. It is preferable that the weakly conductive carbon black is spherical or approximately spherical because the weakly conductive carbon black has a small surface area.

Various weakly conductive carbon blacks can be selectively used. For example, it is favorable to use carbon black produced by a furnace method or a thermal method providing particles having large diameters. It is more favorable to use the furnace carbon black. SRF carbon, FT carbon, and MT carbon are preferable in terms of the classification of carbon. The carbon black for use in pigment may be used.

It is preferable to use not less than five parts by mass of the weakly conductive carbon black for 100 parts by mass of the rubber component so that the weakly conductive carbon black substantially displays the effect of reducing the dielectric loss tangent of the semiconductive rubber composition. It is preferable to use not more than 70 parts by mass of the weakly conductive carbon black for 100 parts by mass of the rubber component to prevent an increase of the hardness of the semiconductive rubber composition so that the semiconductive roller composed of the semiconductive rubber composition does not damage other members which contact the semiconductive roller and prevent a decrease of the wear resistance thereof.

To favorably mix the weakly conductive carbon black with other components, the mixing amount of the weakly conductive carbon black is set to more favorably 5 to 60 parts by mass and most favorably 10 to 50 parts by mass for 100 parts by mass of the rubber component.

The calcium carbonate treated with the fatty acid is more active than ordinary calcium carbonate and lubricant, because the fatty acid is present on the interface of the calcium carbonate. Thus it is possible to realize a high degree of dispersion of the calcium carbonate treated with the fatty acid easily and reliably. When the polarization action is accelerated by the treatment of the calcium carbonate with the fatty acid, there is an increase in the capacitor-like operation in the rubber owing to the above-described two actions. Thus the dielectric loss tangent of the semiconductive rubber composition can be efficiently reduced. It is preferable that the surfaces of particles of the calcium carbonate treated with fatty acid are entirely coated with the fatty acid such as stearic acid.

It is preferable that the mixing amount of the calcium carbonate treated with fatty acid is 30 to 80 parts by mass and favorably 40 to 70 parts by mass for 100 parts by mass of the rubber component. It is preferable that the mixing amount of the calcium carbonate treated with fatty acid is not less than 30 parts by mass for 100 parts by mass of the rubber component so that it substantially displays the effect of reducing the dielectric loss tangent of the semiconductive rubber composition. To prevent the rise of the hardness of the semiconductive rubber composition and a fluctuation of the electric resistance thereof, it is preferable that the mixing amount of the calcium carbonate treated with fatty acid is not more than 80 parts by mass for 100 parts by mass of the rubber component.

The above-described semiconductive rubber member of the present invention having the base layer and the surface layer can be produced by known methods according to the configuration thereof or the application thereof. For example, the semiconductive rubber member can be produced by the following method:

Initially the components composing the base layer are kneaded sufficiently to form a rubber composition. Similarly the components composing the surface layer are kneaded sufficiently to form a rubber composition.

The rubber compositions are molded to form the base layer and the surface layer and the intermediate layer as necessary. A known molding method may be used. For example, raw rubber may be molded by pressing. Alternatively after rubber is extruded in a plurality of layers, it is vulcanized with a vulcanizing can, by continuous vulcanization or by pressing. It is preferable to extrude the rubber in a plurality of layers and vulcanize it by the vulcanizing can or the continuous vulcanization to adjust the thickness of the rubber favorably and produce the semiconductive rubber member at a low cost.

Thereafter when the semiconductive rubber member of the present invention is formed into a roller, a metal shaft is inserted into the center thereof. The metal shaft may be inserted into the rubber roller before it is vulcanized. The metal shaft may be fixed to the rubber roller by press fit or by bonding it to the rubber roller with a conductive adhesive agent. The metal shaft is made of metal such as aluminum, aluminum alloy, SUS or iron, or ceramics.

Thereafter the surface of the rubber roller is polished as desired. The abrading method is not restricted to a specific method. When the semiconductive rubber member of the present invention is roller-shaped, traverse abrasion is used with a cylindrical abrader and thereafter the surface thereof is planished.

It is preferable that an oxide film is formed on the surface of the surface layer of the semiconductive rubber member of the present invention. The oxide film serves as a dielectric layer and is capable of decreasing the dielectric loss tangent of the semiconductive rubber member. The oxide film also serves as a low-frictional layer. Thereby toner separates easily from the surface layer. Hence images can be formed easily. Consequently high-quality images can be obtained.

It is preferable that the oxide film has a large number of C═O groups or C—O groups. The oxide film is formed by irradiating the surface of the surface layer with ultraviolet rays and/or ozone and oxidizing the surface of the surface layer. It is preferable to form the oxide film by irradiating the surface of the surface layer with ultraviolet rays because the use of the ultraviolet rays allows a treating period of time to be short and the oxide film-forming cost to be low.

The treatment for forming the oxide film can be made in accordance with known methods. For example, it is favorable that the surface of the surface layer is irradiated with ultraviolet rays having a wavelength of 100 nm to 400 nm and more favorably 100 nm to 300 nm for 30 seconds to 30 minutes and favorably one to 10 minutes, although the wavelength of the ultraviolet rays to be used varies according to the distance between the surface of the surface layer and an ultraviolet ray irradiation lamp and the kind of rubber. It is preferable to supply an energy of 500 to 4000 $mJ/cm^2$.

In irradiating the surface of the surface layer composed of the rubber composition with the ultraviolet ray, the mixing amount of the rubber such as the NBR liable to be deteriorated with the ultraviolet ray is set to favorably not more than 90 parts by mass and more favorably not more than 80 parts by mass for 100 parts by mass of the rubber component. On the other hand, it is very effective that the rubber composition contains the chloroprene and the chloroprene rubber.

Supposing that the electric resistance of the semiconductive rubber member is R50 when a voltage of 50V is applied thereto before the oxide film is formed thereon and that the electric resistance thereof is R50a when the voltage of 50V is applied thereto after the oxide film is formed thereon, it is favorable that $\log(R50a)-\log(R50)=0.2$ to 1.5. By setting the electric resistance of the semiconductive rubber member to the above-described range, it is possible to provide the semiconductive rubber member with improved durability, reduce a variation of the electric resistance when it is in operation, reduce a stress on toner, and prevent the electrophotographic photoreceptor from being contaminated or damaged. Because the index value of the electric resistance value of the semiconductive rubber member is set at a low voltage of 50 volts at which a voltage can be stably applied thereto, it is possible to accurately capture a slight rise of the electric resistance caused by the formation of the oxide film. The lower limit value of $\log(R50a)-\log(R50)$ is more favorably 0.3 and most favorably 0.5. The upper limit value of $\log(R50a)-\log(R50)$ is more favorably 1.2 and most favorably 1.0.

It is preferable that the semiconductive rubber member produced in the above-described manner has the following properties:

In order for the semiconductive rubber member of the present invention to favorably impart a high electrostatic property to toner and improve the persistency of the electrostatic property for a long time, it is preferable to set the dielectric loss tangent of the semiconductive rubber member of the present invention to the range of 0.1 to 1.5, when an alternating voltage of 5V is applied thereto at a frequency of 100 Hz.

The dielectric loss tangent means an index indicating the flowability of electricity (conductivity) and the degree of influence of a capacitor component (electrostatic capacity). In other words, the dielectric loss tangent is a parameter indicating a phase delay when an alternating current is applied to the semiconductive rubber member, namely, a rate of the capacitor component when a voltage is applied thereto. That is, the dielectric loss tangent is indicated by a charged amount of the toner generated when the toner is brought into contact with the developing roller at a high voltage by means of an amount regulation blade and a charged amount which escapes to the roller composed of the semiconductive rubber member before the toner is transported to the electrophotographic photoreceptor. Thus the dielectric loss tangent is an index showing the charged amount of the toner immediately before the toner contacts the electrophotographic photoreceptor.

When the dielectric loss tangent is large, it is easy to flow electricity (electric charge) through the roller, which does not accelerate a polarization action. On the other hand, when the dielectric loss tangent is small, it is not easy to flow electricity (electric charge) through the roller, which accelerates the polarization action. Thus when the dielectric loss tangent is small, the semiconductive rubber member has a high capacitor-like property, thereby maintaining the electric charge on the toner generated by a frictional charge without escaping the electric charge from the semiconductive rubber member. That is, the semiconductive rubber member is capable of imparting the electrostatic property to the toner and maintaining the electrostatic property imparted thereto. To obtain the above-described effect, the dielectric loss tangent is set to not more than 1.5. To prevent the print density from becoming too low owing to an excessive increase of the charged amount of the toner and prevent the semiconductive rubber member from becoming hard owing to the addition of a large amount of additives used to adjust the dielectric loss tangent, the dielectric loss tangent is set to not less than 0.1.

The dielectric loss tangent is more favorably not less than 0.2 and not more than 1.0.

The dielectric loss tangent of the semiconductive rubber member is measured by a method which will be described later.

The reason the slight voltage of 5V is applied to the semiconductive rubber member as the condition in which the dielectric loss tangent thereof is measured is as follows: When developing roller composed of the semiconductive rubber member holds toner thereon or when it transports the toner to the electrophotographic photoreceptor, a very small voltage fluctuation occurs.

The frequency of 100 Hz is suitable in consideration of the number of rotations of the developing roller and nips between the developing roller and the electrophotographic photoreceptor, the blade, and a toner supply roller with which the developing roller contacts or to which the developing roller is proximate.

The friction coefficient of the semiconductive rubber member of the present invention is set to favorably the range of 0.1 to 1.5. The toner is subjected to a stress such as a shearing force between the developing roller and the toner supply roller as well as the amount regulation blade. To decrease the stress, the coefficient of friction of the semiconductive rubber member is set to preferably not more than 1.5. To prevent the toner from slipping and transport a sufficient amount of toner, the coefficient of friction of the semiconductive rubber member is set to preferably not less than 0.1.

The lower limit of the coefficient of friction of the semiconductive rubber member is set to more favorably not less than 0.25, whereas the upper limit of the coefficient of friction thereof is set to more favorably not more than 0.8. If the coefficient of friction of the semiconductive rubber member is less than 0.25, a large amount of additives for adjusting the coefficient of friction thereof is required, which makes processing difficult. The reason the upper limit of the coefficient of friction of the semiconductive rubber member is set to 0.8 is because it is possible to improve an initial charged amount of the toner and prevent the charged amount thereof from decreasing in the latter part of a durability period of time.

The surface roughness Rz of the semiconductive rubber member of the present invention is set to favorably not more than 10 μm, more favorably not more than 8 μm, and most favorably not more than 5 μm. By setting the surface roughness Rz of the conductive rubber roller to the above-described range, the diameters of concave and convex portions of the surface thereof present on the surface of the conductive rubber roller are smaller than the diameters of toner particles. Thus it is possible to transport the toner uniformly and improve the flowability of the toner. Consequently it is possible to impart the electrostatic property to the toner with a very high efficiency. It is preferable that the surface roughness Rz is small but is set to normally not less than 1 μm. When the surface roughness Rz is less than 1 μm, it is difficult to transport the toner.

The surface roughness Rz is measured in conformity to JIS B 0601 (1994).

It is preferable that the semiconductive rubber member of the present invention has a hardness not more than 75 degrees and favorably not more than 70 degrees when the hardness thereof is measured in conformity to the type-A hardness test, in which a durometer is used, specified in JIS K 6253. This is for the reason described below: The softer the semiconductive rubber member is, the larger is the nip. Consequently transfer, electric charging, and development can be efficiently accomplished. In addition, it is possible to reduce mechanical damage to other members such as the electrophotographic photoreceptor. It is preferable that the lower limit value of the hardness of the semiconductive rubber member is set as low as possible. But to allow the semiconductive rubber member to have a desired degree of wear resistance, the hardness thereof is set to favorably not less than 40 degrees and more favorably not less than 50 degrees.

The compression set of the semiconductive rubber member is set to favorably not more than 10% and more favorably not more than 9.5% when the compression set is measured in accordance with JIS K 6262. When the compression set is not more than 10%, rollers and belts composed of the semiconductive rubber member have a small dimensional change and have improved durability. Thereby an image-forming apparatus is capable of maintaining a high accuracy for a long time. The lower limit of the compression set of the semiconductive rubber member is set to favorably 1% to optimize a vulcanization condition and achieve a stable mass-productivity. As the conditions in which the compression is measured, the measuring temperature, the measuring period of time, and the compression percentage are set to 70°, 24 hours, and 25% respectively.

The second invention provides the developing roller, composed of the semiconductive rubber member of the present invention, which is used for an image-forming mechanism of office automation electrophotographic apparatuses such as a laser beam printer, an inject printer, a copying machine, a facsimile, and the like and an ATM.

The developing roller is preferably used to transport unmagnetic one-component toner to the electrophotographic photoreceptor.

The developing method used in the image-forming mechanism of the electrophotographic apparatus is classified into a contact type and a noncontact type in terms of the relationship between the electrophotographic photoreceptor and the developing roller. The semiconductive rubber member of the present invention can be utilized in both types. When the semiconductive rubber member of the present invention is used as the developing roller, it is preferable that the developing roller substantially contacts the electrophotographic photoreceptor.

In this case, the unmagnetic one-component toner is applicable to be positively and negatively charged.

The second invention provides the developing roller, composed of the semiconductive rubber member of the present invention, for use in an image-forming apparatus in which the unmagnetic one-component toner to be positively charged is used. The surface layer of the developing roller contains at least 20 parts by mass of chloroprene rubber for 100 parts by mass of the rubber component. The chloroprene rubber is contained in the rubber component in a larger amount than the NBR rubber or the polyether copolymer.

In addition to the developing roller, the semiconductive rubber member of the present invention can be used as a cleaning roller or a cleaning blade for removing residual toner, a charging roller having a cleaning function, a charging roller for uniformly charging an electrophotographic drum, a transfer roller for transferring a toner image from the electrophotographic photoreceptor to a transfer belt and paper, and a toner supply roller for transporting toner.

The effect of the present invention is described below. In the semiconductive rubber member of the present invention, the surface layer restrains the variation of the electric resistance generated because the base layer shows electro-conductivity. Thus it is possible to make the electrical property of the semiconductive rubber member uniform. Particularly it is possible to suppress the rise of the electric resistance value to a very high extent even in the low temperature and humidity condition.

Therefore the developing roller composed of the semiconductive rubber member imparts the electrostatic property to the toner by controlling the electrostatic property of the toner and is capable of maintaining the electrostatic property imparted thereto. Consequently a high-quality image can be obtained for a long time. In addition, the semiconductive rubber member stabilizes the charged amount of the toner even in the low temperature and humidity condition and is capable of preventing deterioration of the print density.

Further the semiconductive rubber member of the present invention is capable of controlling positive and negative electrostatic properties in a wide range by altering the construction and composition of the base and surface layers thereof. As a result, when the semiconductive rubber member of the present invention is used as the developing roller, it is capable of charging both the toner to be positively charged and the toner to be negatively charged in an appropriate amount.

DETAILED DESCRIPTION OF THE PREFERRED EMBODIMENTS

A semiconductive rubber roller 10 of the present invention is described below as one embodiment of the semiconductive rubber member of the present invention.

Figure 1:
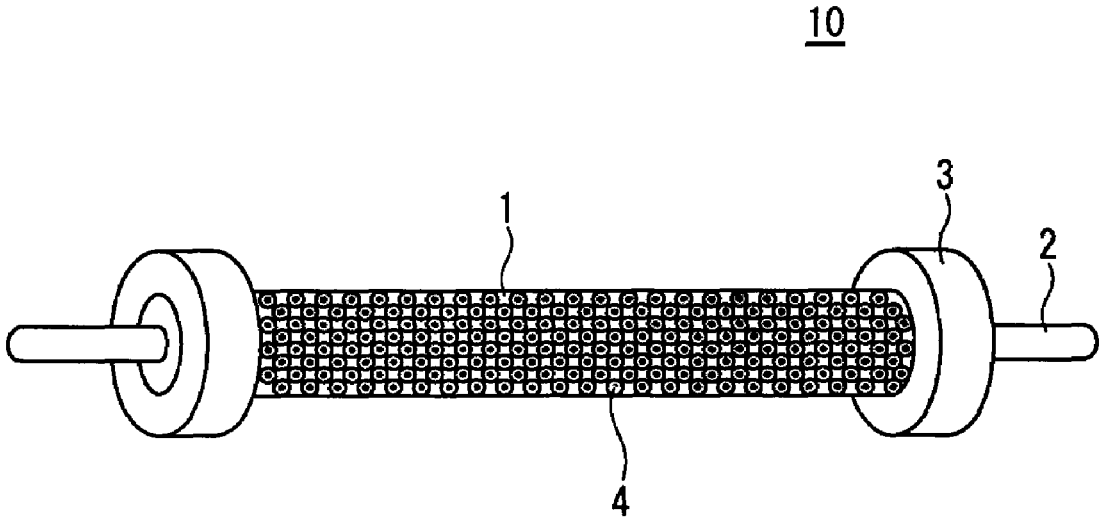
FIG. 1 is schematic view showing a semiconductive rubber roller which is one embodiment of the semiconductive rubber member of the present invention.

As shown in FIG. 1, the semiconductive rubber roller 10 used as a developing roller has a cylindrical toner-transporting portion 1 having a thickness of 0.5 mm to 20 mm, favorably 1 to 15 mm, and more favorably 5 to 15 mm; a columnar metal shaft 2 inserted into a hollow portion of the semiconductive roller 10 by press fit; and a pair of annular sealing portions 3 for preventing leak of a toner 4. The toner-transporting portion 1 and the metal shaft 2 are bonded to each other with a conductive adhesive agent. The reason the thickness of the toner-transporting portion 1 is set to 0.5 mm to 20 mm is as follows: If the thickness of the toner-transporting portion 1 is less than 0.5 mm, it is difficult to obtain an appropriate nip. If the thickness of the toner-transporting portion 1 is more than 20 mm, the toner-transporting portion 1 is so large that it is difficult to produce a small and light-weight an apparatus in which the developing rubber roller 10 is mounted.

The metal shaft 2 is made of metal such as aluminum, aluminum alloy, SUS or iron, or ceramics.

The sealing portion 3 is made of nonwoven cloth such as Teflon (registered trade mark) or a sheet.

Figure 2:
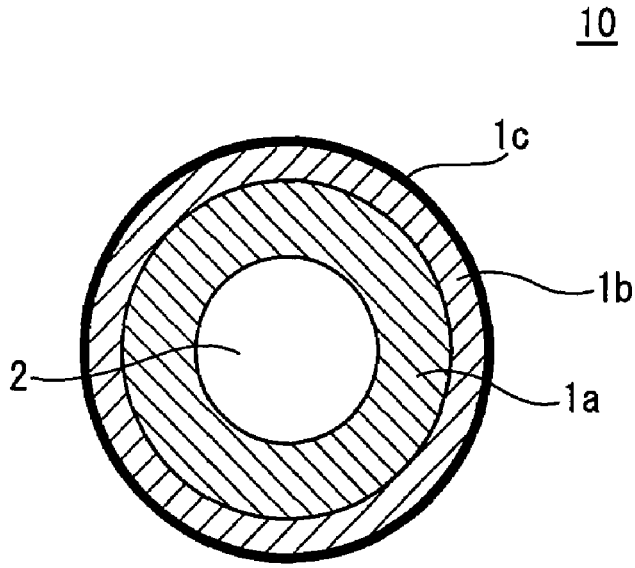
FIG. 2 is a sectional view showing a toner-transporting portion of the semiconductive rubber roller.

As apparent from a sectional view of the toner-transporting portion 1 shown in FIG. 2, the toner-transporting portion 1 has a two-layer construction. More specifically, a base layer 1*a* is present adjacently to the metal shaft 2, and a surface layer 1*b* is layered on the base layer 1*a*. An oxide film 1*c* is formed on the surface of the toner-transporting portion 1.

The ratio of the thickness of the base layer 1*a* to that of the surface layer 1*b* is set to favorably 5 to 9.5:5 to 0.5 and more favorably 7 to 9:3 to 1.

The electric resistance value of the semiconductive rubber roller 10 is set to the range of $10^5\Omega$ to $10^{6.5}\Omega$ when the electric resistance value thereof is measured by applying a voltage of 100V thereto at a temperature of 10° C. and a relative humidity of 20%.

The electric resistance value of the base layer 1*a* is set to the range from $10^3\Omega$ to $10^5\Omega$ and favorably the range from $10^4\Omega$ to $10^5\Omega$ when the electric resistance value thereof is measured by applying the voltage of 100V thereto at the temperature of 10° C. and the relative humidity of 20%. The deflection of the electric resistance value of the base layer 1*a* is set below 20.

The electric resistance value of the semiconductive rubber roller 10 is set higher than that of the base layer 1*a*, when the electric resistance values thereof are measured by applying the voltage of 100V thereto at the temperature of 10° C. and the relative humidity of 20%.

As a rubber composition composing the base layer 1*a*, a rubber composition containing a rubber component and an electro-conductive agent mixed therewith is used.

As the above-described rubber component, it is favorable to use polar rubber such as NBR, chloroprene rubber, and urethane rubber having a high dissolution parameter (SP value) respectively. It is more favorable to use the chloroprene rubber. The chloroprene rubber, of sulfur-unmodified type, which has a low crystallization speed is preferable. It is preferable to use conductive carbon black as the above-described electro-conductive agent. It is preferable to set the mixing amount of the electro-conductive agent to 10 to 25 parts by mass for 100 parts by mass of the rubber component.

As a rubber composition composing the surface layer 1*b*, a substantially insulating rubber composition or an ionic-conductive rubber composition is used.

As "the substantially insulating rubber composition", it is favorable to use non-polar rubber such as EPDM, BR, and the like; and the polar rubber such as SBR, NBR, chloroprene rubber, urethane rubber, and the like having a high dissolution parameter (SP value) respectively. It is more favorable to use the EPDM or the chloroprene rubber.

As the EPDM, the unextended type is preferable. As the diene monomer, the EPDM rubber containing ethylidenenorbornene is preferable. The EPDM containing ethylene at 50 to 70 mass % is especially preferable.

As the above-described ionic-conductive rubber composition, a rubber composition containing an epichlorohydrin copolymer, a polyether copolymer, and a chloroprene rubber as its rubber component is especially preferable. Supposing that the entire mass of the rubber components is 100 parts by mass, as the mixing ratio among the three rubber components, the content of the epichlorohydrin copolymer, that of the polyether copolymer, and that of the chloroprene rubber are set to 10 to 40 parts by mass, 5 to 20 parts by mass, and 40 to 85 parts by mass.

As the above-described ionic-conductive rubber composition, a composition containing the epichlorohydrin copolymer, the chloroprene rubber, and NBR is also especially preferable. Supposing that the entire mass of the rubber components is 100 parts by mass, the content of the epichlorohydrin rubber is set to 10 to 50 parts by mass and preferably 10 to 40 parts by mass; the content of the chloroprene rubber is set to 5 to 85 parts by mass and preferably 40 to 85 parts by mass; and the content of the NBR rubber is set to 5 to 65 parts by mass and preferably 5 to 20 parts by mass.

As the epichlorohydrin copolymer, a terpolymer of the ethylene oxide, the epichlorohydrin, and the allyl glycidyl ether is used. The content ratio among the ethylene oxide, the epichlorohydrin, and the allyl glycidyl ether is set to 40 to 70 mol %:20 to 60 mol %:2 to 6 mol %.

As the chloroprene rubber, a sulfur-unmodified type is used.

As the polyether copolymer, a terpolymer of the ethylene oxide, a propylene oxide, and the allyl glycidyl ether is used. The content ratio among the ethylene oxide, the propylene oxide, and the allyl glycidyl ether is set to 80 to 95 mol %:1 to 10 mol %:1 to 10 mol %. The number-average molecular weight Mn of the copolymer is set to favorably not less than 10,000, more favorably not less than 30,000, and most favorably not less than 50,000.

As the NBR, low-nitrile NBR containing acrylonitrile at not more than 25% is used.

Both the rubber composition composing the base layer 1*a* and the rubber composition composing the surface layer 1*b* contain a vulcanizing agent for vulcanizing the rubber component.

As the vulcanizing agent, sulfur and ethylene thiourea are used in combination. The mixing amount of the vulcanizing agent is set to not less than one part by mass nor more than three parts by mass for 100 parts by mass of the rubber component. It is preferable to mix the sulfur and the ethylene thiourea at (sulfur:ethylene thiourea)=1:0.05 to 8. The reason the lower limit of the ratio of the part by mass of the ethylene thiourea to that of the sulfur is set to 0.05 is because when the sulfur and the ethylene thiourea are used in combination, the ethylene thiourea is effective for vulcanizing the rubber component, even though a small amount of the ethylene thiourea is used. The reason the upper limit of the ratio the part by mass of the ethylene thiourea to that of the sulfur is set to 8 is as follow: If the ratio exceeds 8, the rubber component scorches in a short period of time, and hence it is liable to burn. Therefore processability is low when a plurality of layers is formed.

It is more favorable to set the mixing mass ratio between the sulfur and the ethylene thiourea to (sulfur:ethylene thiourea)=1:1.5 to 4. To decrease the compression set, it is preferable to set the mixing ratio between the sulfur and the ethylene thiourea to (sulfur:ethylene thiourea)=1:1.5.

The rubber composition composing the base layer 1*a* and the rubber composition composing the surface layer 1*b* may contain other components in addition to the rubber component and the vulcanizing agent.

A filler is used as one of the other components. Zinc oxide is used as the filler. Conductive carbon black which is an electro-conductive agent and weakly conductive carbon black which is described below also serve as the filler. The addition amount of the filler is set to 10 to 70 parts by mass and preferably 10 to 50 parts by mass for 100 parts by mass of the rubber component.

An acid-accepting agent is contained in the rubber composition containing halogen-containing rubber represented by the epichlorohydrin copolymer. As the acid-accepting agent, hydrotalcite is used. The mixing amount of the acid-accepting agent is set to not less than 1 part by mass nor more than 10 parts by mass for 100 parts by mass of the rubber component.

The rubber composition composing the surface layer 1*b* contains the weakly conductive carbon black as a dielectric loss tangent-adjusting agent.

The weakly conductive carbon black used in the present invention has an average primary diameter of 100 to 250 nm and is spherical or has a configuration similar to the spherical shape. The mixing amount of the weakly conductive carbon black is set to favorably 5 to 70 parts by mass and more favorably 5 to 30 parts by mass for 100 parts by mass of the rubber component. By mixing the weakly conductive carbon black with the rubber component, it is possible to decrease the dielectric loss tangent of the semiconductive rubber roller of the present invention and decrease a tacky feeling of the surface of the rubber roller and further separate toner therefrom favorably.

The method of producing the semiconductive rubber roller 10 is described below.

Initially the rubber composition composing the base layer 1*a* and the rubber composition composing the surface layer 1*b* are formed.

For example, components of the rubber composition are mixed with one another by using a known kneader such as a Banbury mixer, a kneader, an open roll or the like. A mixture obtained by kneading the components one another may be pellet-shaped, sheet-shaped or ribbon-shaped. A temperature at a kneading time and a kneading period of time are appropriately selected. The mixing order is not specifically limited either. All the components may be mixed with one another. Alternatively after a part of all the components is mixed with one another, other components may be mixed with an obtained mixture.

More specifically, after the rubber component, the conductive carbon black or the weakly conductive carbon black, and the zinc oxide are supplied to the kneader, these components are kneaded at a discharge temperature of 80 to 150° C. After the vulcanizing agent and other additives such as the acid-accepting agent are added to the kneaded components, the components are kneaded by using a roller for 1 to 30 minutes and preferably 1 to 15 minutes. The acid-accepting agent is used as desired. The obtained kneaded material is formed into a ribbon-shaped compound.

Using the rubber composition composing the base layer 1*a* and the rubber composition composing the surface layer 1*b*, the rubber is extruded in two layers at a collet temperature of 40 to 80° C. to obtain a tubular roller having the base layer 1*a* and the surface layer 1*b*. The thickness of each of the two layers can be arbitrarily set by altering the configuration of a collet and the collet temperature at the time of extrusion in consideration of the design and abrasion area of a final product and a vulcanization-caused volume change of the rubber.

The preform is vulcanized at 160° C. for 15 to 120 minutes.

An optimum vulcanizing time period should be set by using a vulcanization testing rheometer (for example, Curelastmeter). The vulcanization temperature may be set around 160° C. in dependence on necessity. To prevent the semiconductive rubber member from contaminating the electrophotographic photoreceptor and the like and reduce the degree of the compression set thereof, it is preferable to set conditions in which the preform is vulcanized so that a possible largest vulcanization amount is obtained. A conductive foamed roller may be formed by adding a foaming agent to the rubber component.

After the metal shaft 2 is inserted into the roller and bonded thereto, the surface thereof is polished and cut to a necessary dimension. The metal shaft 2 may be inserted into the roller before it is vulcanized.

The surface of the roller is irradiated with ultraviolet rays to form the oxide film 1*c* on the surface thereof. More specifically, after the roller is washed with water by using an ultraviolet ray irradiator, the surface of the roller is irradiated with ultraviolet rays (wavelength: 184.9 nm and 253.7 nm) at intervals of 90 degrees in its circumferential direction of the roller for three to eight minutes and with the ultraviolet ray irradiation lamp spaced at 10 cm from the roller. The roller is rotated by 90 degrees four times to form the oxide film on its entire peripheral surface (360 degrees).

The dielectric loss tangent of the semiconductive rubber roller 10 is set to 0.1 to 1.5 and preferably 0.2 to 1.0, when an alternating voltage of 5V is applied thereto at a frequency of 100 Hz. The semiconductive rubber roller imparts a high electrostatic property to toner to a high extent and keeps the electrostatic charge imparted thereto.

Figure 4:
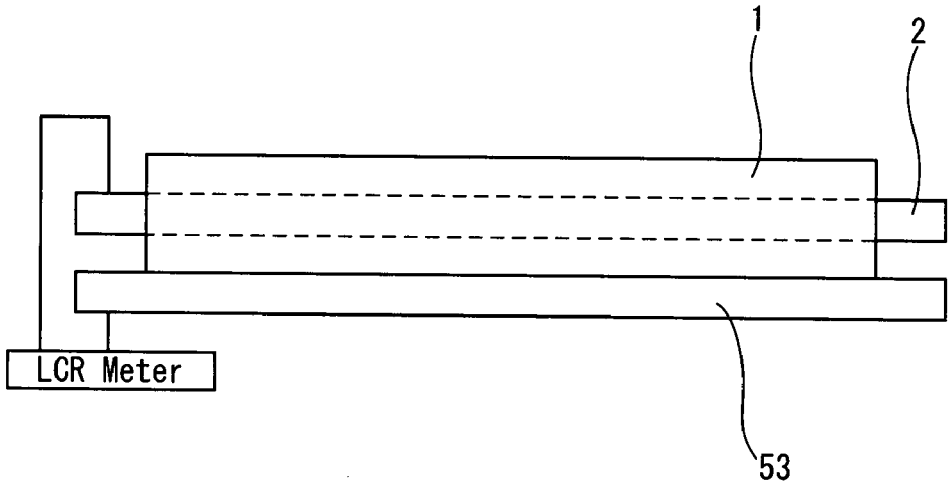
FIG. 4 shows a method of measuring a dielectric loss tangent of the semiconductive rubber roller.

The dielectric loss tangent is measured as follows:

As shown in FIG. 4, an alternating voltage of 100 Hz to 100 kHz is applied to a toner-transporting portion 1 placed on a metal plate 53. A metal shaft 2 and the metal plate 53 serve as an electrode respectively. An R (electric resistance) component and a C (capacitor) component are measured separately by an LCR meter ("AG-4311B" manufactured by Ando Denki Co., Ltd.) at a constant temperature of 23° C. and a constant relative humidity of 55%. The dielectric loss tangent is computed from the value of R and C by using the following equation.

$$\text{Dielectric loss tangent } (\tan\delta)=G/(\omega C),\ G=1/R$$

The dielectric loss tangent is found as G/ωC, when the electrical characteristic of one roller is modeled as a parallel equivalent circuit of the electric resistance component of the roller and the capacitor component thereof.

The coefficient of friction of the semiconductive rubber roller 10 is set to 0.1 to 1.5 and preferably 0.25 to 0.8.

Figure 5:
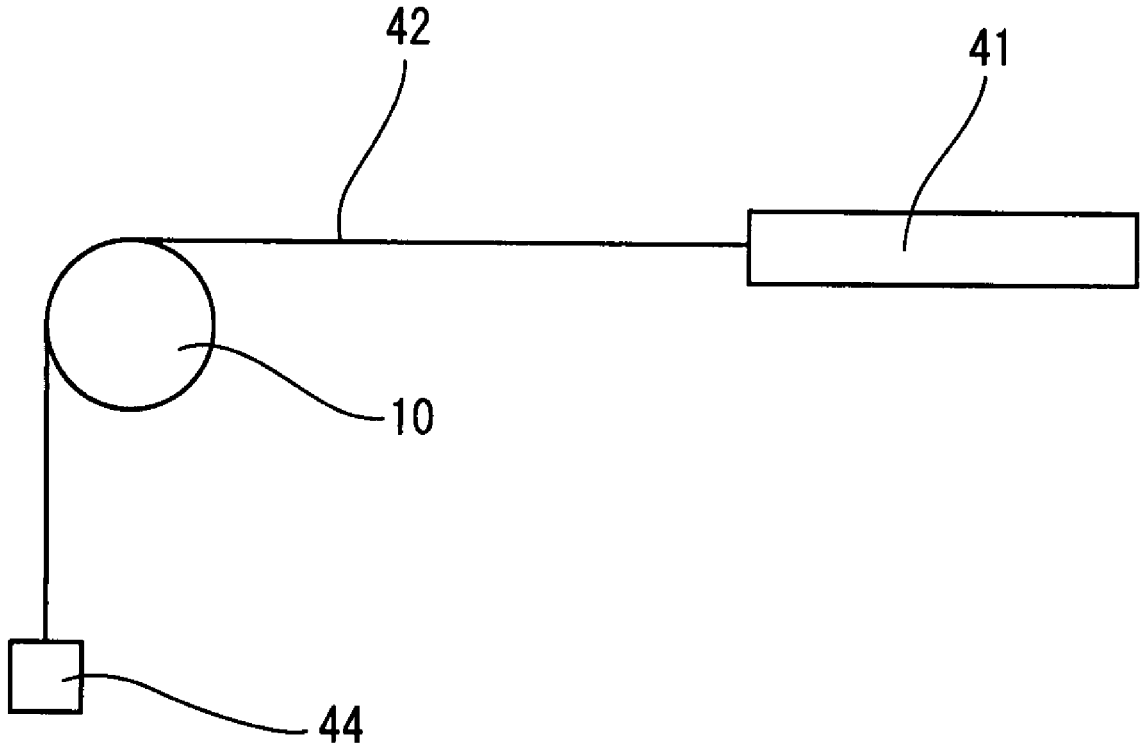
FIG. 5 shows a method of measuring a coefficient of friction of the semiconductive rubber roller.

With reference to FIG. 5, the friction coefficient of the semiconductive rubber roller 10 is measured by substituting a numerical value measured with a digital force gauge 41 of an apparatus into the Euler's equation. The apparatus has a digital force gauge ("Model PPX-2T" manufactured by Imada Inc.) 41, a friction piece (commercially available OHP film, made of polyester, in contact with the peripheral surface of the semiconductive roller 43 in an axial length of 50 mm) 42, a weight 44 weighing 20*g*, and the semiconductive roller 10.

The amount of toner which can be transported by the semiconductive rubber roller 10 is set to 0.01 to 1.0 mg/cm$^2$.

In a print test of the semiconductive rubber roller 10 of each of examples and comparison examples, printing is carried out by using a cartridge allowing 5%-printing to be accomplished on 7000 sheets of paper. The print density of a printed solid black image at an initial stage and the print density thereof after the solid black image is printed on 2,000 sheets of paper are set to not less than 1.6 and favorably not less than 1.8. Further the difference between the print density of the printed solid black image at the initial stage and the print density thereof after the solid black image is printed on 2,000 sheets of paper is set to not more than 0.2 and favorably not more than 0.1.

The examples of the present invention and comparison examples are described below. Needless to say, the present invention is not limited to the examples.

(1) Formation of Rubber Composition Composing Base Layer

In accordance with the mixing ratio shown in table 1, the rubber component and the conductive carbon black were sequentially supplied to a 10L kneader. After 5 parts by mass of zinc white ("two kinds of zinc oxide" produced by Mitsui Mining and Smelting Co., Ltd.) was added to 100 parts by mass of the rubber component, the components were kneaded at a discharge temperature of 110° C. After a vulcanizing agent was added to an obtained mixture, the mixture and the vulcanizing agent were kneaded for five minutes by a roller to obtain a ribbon-shaped compound.

As the vulcanizing agent, 0.5 parts by mass of powder sulfur and 1.4 parts by mass of ethylene thiourea ("Accel 22-S" produced by KAWAGUCHI CHEMICAL INDUSTRY CO., LTD.) were used for 100 parts by mass of the rubber component.

(2) Formation of Rubber Composition Composing Surface Layer

In accordance with the mixing ratio shown in table 1, the rubber component, the weakly conductive carbon black, and zinc oxide were sequentially supplied to the 10L kneader. The vulcanizing agent was added to the obtained mixture. When the epichlorohydrin rubber and the chloroprene rubber were used as the rubber component, the acid-accepting agent was added to the obtained mixture. Thereafter all the components were kneaded for five minutes by the roller to obtain a ribbon-shaped compound.

When the epichlorohydrin rubber was used as the rubber component, three parts by mass of hydrotalcite ("DHT-4A-2" produced by Kyowa Chemical Industry Co., Ltd.) was used as the acid-accepting agent for 100 parts by mass of the epichlorohydrin rubber. When the chloroprene rubber was used as the rubber component, five parts by mass of hydrotalcite was used as the acid-accepting agent for 100 parts by mass of the chloroprene rubber. The kind and mixing amount of the zinc oxide and the vulcanizing agent are identical to those of the rubber composition composing the base layer.

(3) Formation of Laminated Roller

Two vacuum-type rubber extruder of ϕ60 were arranged in parallel. The rubber composition composing the base layer and the rubber composition composing the surface layer were supplied to the two vacuum-type rubber extruders respectively. Each extruder was provided with a specific layering portion. The two kinds of the rubber compositions were successively extruded in layers at the collet temperature of 60° C. through a collet so devised that the base layer and the surface layer can be layered. Thereby a tubular laminated roller having a inner diameter of ϕ8.5 mm and a outer diameter of ϕ20.5 mm was obtained.

The thickness of each of the two layers can be arbitrarily set by altering the configuration of the collet and the collet temperature at the time of extrusion in consideration of the design of an end product, an abrasion area of the roller, and a vulcanization-caused volume change of the rubber. In this process, it is possible to remove water other than water adsorbed by bubbles and molecules of the rubber.

A metal shaft having a diameter of ϕ8 mm at a normal pressure was inserted into the obtained roller. The roller was heated at 160° C. for 60 minutes to vulcanize the rubber.

(4) Formation of Oxidized Layer on Surface of Roller

After the surface of each of the rollers was washed with water, the surface thereof was irradiated with ultraviolet rays to form an oxidized layer thereon. By using an ultraviolet ray irradiator ("PL21-200" produced by Sen Tokushu Kogen Inc), the surface of each roller was irradiated with ultraviolet rays (wavelength: 184.9 nm and 253.7 nm) at intervals of 90 degrees in its circumferential direction for five minutes and with the ultraviolet ray irradiation lamp spaced at 10 cm from the roller. Each semiconductive roller was rotated by 90 degrees four times to form an oxide film on its entire peripheral surface (360 degrees). ¼ (corresponding to 90 degrees) of the entire surface of each roller was irradiated for the period of time shown in table 1.

TABLE 1

| | | Example 1 | Example 2 | Example 3 | Example 4 |
|---|---|---|---|---|---|
| Base layer | ECO | | | | |
| | Chloroprene rubber | 100 | 100 | 100 | 100 |
| | Weakly conductive carbon black | | | | |
| | Conductive carbon black | 20 | 20 | 20 | 20 |
| | Electric resistance (logarithmic value) | 4.5 | 4.6 | 4.8 | 4.5 |
| | Electric resistance deflection (logarithmic value) | 2.5 | 2.5 | 2.8 | 2.6 |
| | Conductivity | Electronic | Electronic | Electronic | Electronic |
| | Thickness (mm) | 4.5 | 4.5 | 4.5 | 4.5 |
| Surface layer | GECO | | 25 | 25 | |
| | Chloroprene rubber | 100 | 65 | 65 | |
| | Polyether copolymer | | 10 | | |
| | NBR | | | 10 | |
| | EPDM | | | | 100 |
| | Weakly conductive carbon black | 20 | 10 | 10 | 10 |
| | Conductive carbon black | | | | |
| | Conductivity | Insulating | Ionic | Ionic | Insulating |
| | Thickness (mm) | 0.5 | 0.5 | 0.5 | 0.5 |
| Laminated roller | Electric resistance of roller (logarithmic value) | 6.2 | 5.3 | 5.7 | 6.5 |
| | Oxide film-forming method | Ultraviolet ray 5 minutes | Ultraviolet ray 5 minutes | Ultraviolet ray 5 minutes | Ultraviolet ray 5 minutes |
| Print density | C0 | 1.75 | 2.00 | 2.00 | 1.75 |
| | C2000 | 1.70 | 1.90 | 1.90 | 1.75 |
| | C0-C2000 | 0.05 | 0.10 | 0.10 | 0.00 |
| Evaluation of image | | | | | |
| Decrease of print density owing to rotation of roller | | Did not decrease | Did not decrease | Did not decrease | A little decreased |
| Degree of evenness in print density | | ○ | ○ | ○ | Δ |
| Synthetic evaluation | | ○ | ◎ | ◎ | ○ |

| | | Comparison example 1 | Comparison example 2 | Comparison example 3 |
|---|---|---|---|---|
| Base layer | ECO | | 100 | |
| | Chloroprene rubber | 100 | | 100 |
| | Weakly conductive carbon black | | | |
| | Conductive carbon black | 20 | 5 | 10 |
| | Electric resistance (logarithmic value) | 4.5 | 6.5 | 8.0 |
| | Electric resistance deflection (logarithmic value) | 2.5 | 1.1 | 3.0 |
| | Conductivity | Electronic | Ionic | Electronic |
| | Thickness (mm) | 2.5 | 4.5 | 4.5 |
| Surface layer | GECO | | | |
| | Chloroprene rubber | | | |
| | Polyether copolymer | | | |
| | NBR | | | |
| | EPDM | 100 | 100 | 100 |
| | Weakly conductive carbon black | 10 | 10 | 10 |
| | Conductive carbon black | | | |
| | Conductivity | Insulating | Insulating | Insulating |
| | Thickness (mm) | 2.5 | 0.5 | 0.5 |

TABLE 1-continued

| | | | | |
|---|---|---|---|---|
| Laminated roller | Electric resistance of roller (logarithmic value) | 9.0 | 6.9 | 10.0 |
| | Oxide film-forming method | Ultraviolet ray 5 minutes | Ultraviolet ray 5 minutes | Ultraviolet ray 5 minutes |
| Print density | C0 | 1.50 | 1.77 | 1.30 |
| | C2000 | 1.20 | 1.56 | — |
| | C0-C2000 | 0.30 | 0.21 | — |
| Evaluation of image | | | | |
| Decrease of print density owing to rotation of roller | | Decreased | Decreased | Decreased |
| Degree of evenness in print density | | X | Δ | X |
| Synthetic evaluation | | X | Δ | X |

As the components of the semiconductive rubber roller of each of the examples and the comparison examples, the following substances were used:

Epichlorohydrin rubber (ECO): "Epichroma D" produced by DAISO CO., LTD.

[EO (ethylene oxide)/EP (epichlorohydrin)=61 mol %/39 mol %]

Chloroprene rubber: "Shoprene WRT" produced by Showa Denko K.K.

Epichlorohidrin rubber (GECO): "Epichroma CG102" produced by DAISO CO., LTD.

[ethylene oxide (EO)/epichlorohidrin (EP)/allyl glycidyl ether (AGE)=56 mol %/40 mol %/4 mol %]

Polyether copolymer: "Zeospan ZSN8030" produced by Zeon Corporation.

[ethylene oxide (EO)/propylene oxide (PO)/allyl glycidyl ether (AGE)=90 mol %/4 mol %/6 mol %]

Acrylonitrile-butadiene rubber (NBR): "Nippol 401LL" (low-nitrile NBR containing acrylonitrile at 18%) produced by Zeon Corporation Ethylene-propylene-diene copolymer (EPDM): "Esprene 505A" (oil-unextended type) produced by Sumitomo Chemical Co., Ltd.

Conductive carbon black: "Denka black" produced by Denki Chemical Industry Co., Ltd.

Weakly conductive carbon black: "Asahi #15 (average primary particle diameter: 122 nm) produced by Asahi carbon Co., Ltd.

The following properties of the semiconductive rubber roller of each of the examples and the comparison examples were measured.

Measurement of Electric Resistance of Semiconductive Rubber Roller

Figure 3:
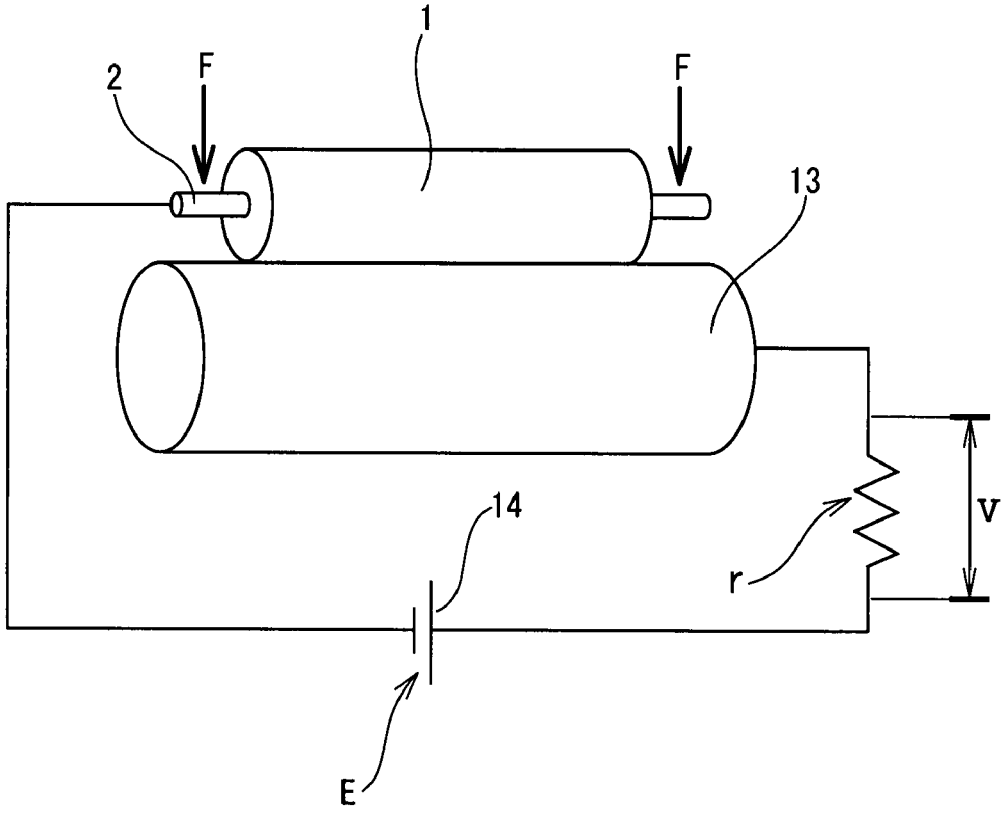
FIG. 3 shows a method of measuring an electric resistance value of the semiconductive rubber roller.

To measure the electric resistance of each roller, as shown in FIG. 3, a toner-transporting portion 1 through which a core 2 was inserted was mounted on an aluminum drum 13, with the toner-transporting portion 1 in contact with the aluminum drum 13. A leading end of a conductor wire having an internal electric resistance of r (100Ω) connected to a positive side of a power source 14 was connected to one end surface of the aluminum drum 13. A leading end of a conductor wire connected to a negative side of the power source 14 was connected to one end surface of the toner-transporting portion 1.

A voltage V applied to the internal electric resistance r of the conductor wire was detected. Supposing that a voltage applied to the apparatus is E, the electric resistance R of the roller is: $R=r\times E/(V-r)$. Because the term $-r$ is regarded as being extremely small, $R=r\times E/V$. A load F of 500 g was applied to both ends of the metal shaft 2. A voltage E of 100V was applied to the roller, while it was being rotated at 30 rpm. The detected voltage V was measured at 100 times during four seconds. The electric resistance value R was computed by using the above equation. The electric resistance value of each roller obtained by computing the average value of obtained values is shown as a logarithmic value in table 1. The measurement was conducted after the rollers were left for not less than 24 hours at a low temperature 23° C. and a low relative humidity of 20%.

Measurement of Electric Resistance of Base Layer

The surface layer of each roller was abraded to form a one-layer construction of the base layer so that the electric resistance value R thereof was measured by using the same method as that described above. An average value of obtained values is shown in table 1 as the electric resistance value of the base layer. (The maximum electric resistance value)/(the minimum electric resistance value) was computed from the obtained maximum and minimum electric resistance values. The obtained value is shown in table 1 as the electric resistance deflection.

Measurement of Electric Resistance of Surface Layer

The surface layer of each roller was shaven off to obtain a one-layer construction of the surface layer so that the volume resistivity of the surface layer was measured, when a voltage of 100V was applied thereto by using a Highrester UR-SS probe (MCP-HTP15) manufactured by Dia Instrument Inc. Because the spot diameter of the probe was ϕ3 mm, the electric resistance value of a small sample like the above-described surface layer can be measured.

Print Test

The semiconductive rubber roller of each of the examples and the comparison examples was mounted on a laser printer (commercially available printer in which unmagnetic one-component toner to be positively charged is used) as a developing roller to evaluate the performance of each roller. A change of the amount of toner outputted as an image, namely, a change of the amount of the toner which deposited on printed sheets was used as the index in the evaluation. The measurement of the deposited amount of the toner on the sheets on which the solid black image was printed can be substituted by measurement of a transmission density described below.

More specifically, the solid black image was printed at the temperature of 10° C. and the relative humidity of 20%. The transmission density was measured by a reflection transmission densitometer ("Tecikon densitometer RT120/Light table LP20" produced by TECHKON Co., Ltd.) at given five points on each obtained sheet on which the solid black image was printed. The average of the transmission densities was set as an initial print density (shown as "C0" in table 1).

Thereafter an image to be printed at 5% was printed on 1,999 sheets of paper at the temperature of 10° C. and the relative humidity of 20%. After the operation of the printer was suspended for 12 hours, the solid black image was printed on 2000th sheet. In a manner similar to the above-described manner, the transmission density was measured for the 2000th sheet on which the solid black image was printed. The average of measured transmission densities was set as the print density (shown as "C2000" in table 1) after the image was printed on 2,000 sheets of paper. The reason the transmission density after the image was printed on 2,000 sheets of paper was measured is because normally a break-in finishes when an image is printed on about 2,000 sheets of paper.

From obtained values, the difference (indicated by C0–C2000) between the initial print density and the print density after the image was printed on 2,000 sheets of paper was computed. Table 1 shows the results.

In the above-described print test, the print density of the solid black image at the initial stage and the print density thereof after it is printed on 2,000 sheets of paper are favorably not less than 1.6 and more favorably not less than 1.8.

The difference between the print density of the solid black image at the initial stage and the print density thereof after it is printed on 2,000 sheets of paper is favorably not more than 0.2 and more favorably not more than 0.1.

Evaluation of Image

The semiconductive rubber roller of each of the examples and the comparison examples was mounted on a commercially available laser printer (commercially available printer in which unmagnetic one-component toner to be positively charged is used) as a developing roller. After an image to be printed at 5% was printed on 100 sheets of paper, a halftone image to be printed at 25% was printed to observe whether the image was evenly printed. Rollers which did not cause uneven print were marked by ○. Rollers which caused uneven print to a slight extent were marked by Δ. Rollers which caused uneven print to a high extent were marked by X. The decrease of the print density caused by the rotation of the roller was also observed.

In the tests conducted on the semiconductive rubber roller of the comparison example 1, both the print density of the solid black image at the initial stage and the print density thereof after it was printed on 2,000 sheets of paper were low. There was a big difference between the print density of the solid black image at the initial stage and the print density thereof after it was printed on 2,000 sheets of paper. In the tests conducted on the semiconductive rubber roller of the comparison example 2, there was also a big difference between the print density thereof at the initial stage and the print density thereof after it was printed on 2,000 sheets of paper. The results indicate that in the semiconductive rubber roller of each of the comparison examples 1 and 2, the print density was low in the low temperature and humidity condition.

In the tests conducted on the semiconductive rubber roller of the comparison example 3, the print density of the printed image at the initial stage was so low that the semiconductive rubber roller cannot be put into practical use.

In addition, the semiconductive rubber roller of each of the comparison examples 1 through 3 caused uneven print and the print density to drop owing to the rotation thereof.

On the other hand, in the tests conducted on the semiconductive rubber rollers of the examples 1 through 4, the print density of the solid black image at the initial stage and the print density thereof after it was printed on 2,000 sheets of paper were more than 1.7. The difference between the print density thereof at the initial stage and the print density thereof after it was printed on 2,000 sheets of paper was not more than 0.1. The results indicate that the semiconductive rubber roller of the present invention prevent the print density from decreasing in the low temperature and humidity condition.

The semiconductive rubber roller of each of the examples 1 through 4 did not cause uneven print nor caused the print density to drop owing to the rotation thereof. These results indicate that the semiconductive rubber roller of the present invention maintains a high-quality image for a long time.

What is claimed is:

1. A semiconductive rubber member comprising not less than two vulcanized rubber layers including a surface layer composed of a vulcanized rubber composition and a base layer composed of a vulcanized electro-conductive rubber composition, wherein an electric resistance value of said base layer is set to not more than $10^7\Omega$, and an electric resistance value of a laminate of all layers including said base layer and said surface layer is set to not more than $10^7\Omega$, when said electric resistance value of said base layer and that of said laminate are measured by applying a voltage of 100V to said base layer and said laminate respectively at a temperature of 10° C. and a relative humidity of 20%.

2. The semiconductive rubber member according to claim 1, wherein said surface layer is composed of an ionic-conductive rubber composition; or/and has a volume resistivity set to not less than $10^{10}\Omega\cdot$cm nor more than $10^{15}\Omega\cdot$cm, when said volume resistivity of said surface layer is measured by applying said voltage of 100V thereto at said temperature of 10° C. and said relative humidity of 20% so that said surface layer has a substantially insulating property;

said electric resistance value of said laminate including said base layer and said surface layer is set higher than an electric resistance value of a rubber layer of said base layer; and a ratio of a maximum of said electric resistance value of said base layer to a minimum of said electric resistance value thereof is set to less than 20, when said electric resistance of said base layer is measured by applying said voltage of 100V thereto at said temperature of 10° C. and said relative humidity of 20%.

3. The semiconductive rubber member according to claim 2, wherein adjacent layers are integrated with each other without interposing an adhesive agent therebetween or/and said adjacent layers contain an identical rubber component.

4. The semiconductive rubber member according to claim 2, comprising said base layer and said surface layer, wherein an oxide film is formed on a surface of said surface layer.

5. A developing roller, for use in an image-forming apparatus, composed of the semiconductive rubber member according to claim 2.

6. The developing roller, according to claim 5, for use in said image-forming apparatus in which an unmagnetic one-component toner to be positively charged is used, wherein a surface layer of said developing roller contains at least 20 parts by mass of chloroprene rubber for 100 parts by mass of a rubber component; and said chloroprene rubber is contained in said rubber component in a larger amount than an NBR rubber or a polyether copolymer.

7. The semiconductive rubber member according to claim 1, wherein adjacent layers are integrated with each other without interposing an adhesive agent therebetween or/and said adjacent layers contain an identical rubber component.

8. The semiconductive rubber member according to claim 1, comprising said base layer and said surface layer, wherein an oxide film is formed on a surface of said surface layer.

9. A developing roller, for use in an image-forming apparatus, composed of the semiconductive rubber member according to claim 1.

10. The developing roller, according to claim 9, for use in said image-forming apparatus in which an unmagnetic one-component toner to be positively charged is used, wherein a surface layer of said developing roller contains at least 20 parts by mass of chloroprene rubber for 100 parts by mass of a rubber component; and said chloroprene rubber is contained in said rubber component in a larger amount than an NBR rubber or a polyether copolymer.

* * * * *